US010845066B2

(12) United States Patent
Hayakawa

(10) Patent No.: US 10,845,066 B2
(45) Date of Patent: Nov. 24, 2020

(54) HEAT SOURCE UNIT OF REFRIGERATING APPARATUS

(71) Applicant: DAIKIN INDUSTRIES, LTD., Osaka (JP)

(72) Inventor: Hironori Hayakawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1763 days.

(21) Appl. No.: 14/228,105

(22) Filed: Mar. 27, 2014

(65) Prior Publication Data

US 2015/0276279 A1 Oct. 1, 2015

(51) Int. Cl.
*F24F 1/22* (2011.01)
*F25B 13/00* (2006.01)

(52) U.S. Cl.
CPC ..... *F24F 1/22* (2013.01); *F25B 13/00* (2013.01)

(58) Field of Classification Search
CPC ..... F24F 1/22; F24F 1/20; F24F 1/60
USPC ..... 62/428, 506, 507
See application file for complete search history.

(56) References Cited

U.S. PATENT DOCUMENTS 4,153,310 A * 5/1979 Loving ..... F24F 1/20 174/559
4,723,419 A * 2/1988 Kessler ..... F24F 1/38 165/145
4,858,683 A * 8/1989 Beehler ..... F24F 13/20 165/122
6,519,966 B1 * 2/2003 Martin, Sr. ..... F24F 1/0059 62/296
6,705,105 B2 * 3/2004 Wendt ..... F24F 1/18 312/257.1
7,363,768 B2 * 4/2008 Fuchikami ..... F24F 1/20 62/259.2
8,763,416 B2 * 7/2014 Hika ..... F24F 1/22 312/100
2007/0006610 A1 * 1/2007 Kawasaki ..... F24F 1/22 62/507
2007/0163295 A1 * 7/2007 Martin, Sr. ..... F24F 1/08 62/507
2010/0226104 A1 * 9/2010 Takeichi ..... F24F 1/22 361/752

FOREIGN PATENT DOCUMENTS

EP 1684022 A1 * 7/2006 ..... F24F 1/24

* cited by examiner

*Primary Examiner* — Filip Zec
(74) *Attorney, Agent, or Firm* — Global IP Counselors, LLP

(57) ABSTRACT

A heat source unit of a refrigerating apparatus includes a heat exchanger, a blower, an electronic component controlling driving of an actuator, a casing having a vent, and first and second partitioning plates. The heat exchanger has first, second, third and fourth side face parts. The first partitioning plate is disposed between the first and fourth side face parts. An interior of the casing has a first space surrounded by the first to fourth side face parts and the first partitioning plate, and a second space partitioned from the first space by the first partitioning plate. The second space is divided by the second partitioning plate into a third space and a fourth space situated below the third space and exposed externally from the casing. The electrical component is disposed in the third space. The second partitioning plate has a first ventilation opening communicating between the third and fourth spaces.

12 Claims, 23 Drawing Sheets

HEAT SOURCE UNIT OF REFRIGERATING APPARATUS

TECHNICAL FIELD

The present invention relates to a heat source unit of a refrigerating apparatus.

BACKGROUND ART

There have been a heat source unit of a refrigerating apparatus that has an electronic component for controlling an actuator.

SUMMARY

In the heat source unit of a refrigerating apparatus as stated above, device reliability can decrease due to the heat generated by the electronic component in some cases during operation. Thus, a heat source unit according to the present invention is configured so that an electronic component is cooled by an air flow that is generated by a blower during operation.

Specifically, a heat source unit of a refrigerating apparatus according to a first aspect has a heat exchanger, a blower, an electronic component, a casing, a first partitioning plate, and a second partitioning plate. The electronic component controls driving of an actuator. The casing is formed a vent that is configured and arranged to vent air upward. The casing houses the heat exchanger, the blower, and the electronic component. The first partitioning plate and the second partitioning plate are disposed in the casing. The heat exchanger has a first side face, a second side face, a third side face, and a fourth side face. The second side face adjoins the first side face. The third side face adjoins the second side face and opposes the first side face. The fourth side face adjoins the third side face and opposes the second side face. The first partitioning plate is disposed between the first side face and the fourth side face. A first space and a second space are formed in the casing. The first space is a space that is surrounded by the first side face, the second side face, the third side face, the fourth side face, and the first partitioning plate. The second space is partitioned from the first space by the first partitioning plate. The second space is divided into a third space and a fourth space by the second partitioning plate. The electronic component is disposed in the third space. The fourth space is situated under the third space. The fourth space is externally exposed from the casing. A first ventilation opening is formed in the second partitioning plate. The first ventilation opening is an opening that communicates between the third space and the fourth space.

Consequently, an air flow flows from exterior of the casing into the third space in which the electronic component is disposed. As a result, the electronic component is cooled by the air flow that flows into the third space, and an increase in the temperature of the electronic component is inhibited.

A heat source unit of a refrigerating apparatus according to a second aspect is the heat source unit of a refrigerating apparatus according to the first aspect, with a first member being disposed in the fourth space. The first member is a member configured and arranged to form a first air flow path. The first air flow path communicates with the first ventilation opening. The first member has a first bending part. The first bending part is a portion that is configured and arranged to bend the first air flow path.

Consequently, the first airflow path that leads to the third space is formed with a bend. As a result, ingress of liquid, and/or small animals, and the like into the third space is inhibited.

A heat source unit of a refrigerating apparatus according to a third aspect is the heat source unit of a refrigerating apparatus according to the second aspect, with the first member adjoining the second partitioning plate in the fourth space side. The first bending part extends in a direction that intersects the second partitioning plate.

Consequently, ingress of liquid, and/or small animals, and the like into the third space is inhibited by a simple configuration.

A heat source unit of a refrigerating apparatus according to a fourth aspect is the heat source unit of a refrigerating apparatus according to the third aspect, with the second partitioning plate extending along the horizontal direction. The first bending part extends along the vertical direction directly below the second partitioning plate.

Consequently, ingress of liquid, and/or small animals, and the like into the third space is inhibited by a simple configuration.

A heat source unit of a refrigerating apparatus according to a fifth aspect is the heat source unit of a refrigerating apparatus according to the first aspect, the first ventilation opening being configured with a plurality of slits that are formed in the second partitioning plate.

Consequently, ingress of liquid, and/or small animals, and the like into the third space is inhibited by a simple configuration.

A heat source unit of a refrigerating apparatus according to a sixth aspect is the heat source unit of a refrigerating apparatus according to the first aspect, the blower being disposed in the first space. A second member is disposed between the first space and the third space. The second member is a member configured and arranged to form a second air flow path. The second air flow path is a flow path for air that communicates between the first space and the third space.

Consequently, air flow that is generated by the blower flows into the third space. As a result, the electronic component is cooled by the air flow that is generated by the blower, and an increase in the temperature of the electronic component is inhibited.

A heat source unit of a refrigerating apparatus according to a seventh aspect is the heat source unit of a refrigerating apparatus according to the sixth aspect, the second member having a second bending part. The second bending part is a portion that is configured and arranged to bend the second air flow path.

Consequently, the second air flow path leading to the third space is formed with a bend. As a result, ingress of liquid, and/or small animals, or the like from the first space to the third space is inhibited.

A heat source unit of a refrigerating apparatus according to an eight aspect is the heat source unit of a refrigerating apparatus according to the seventh aspect, the second member adjoining the first partitioning plate in the first space side. The second air flow path is formed between the first partitioning plate and the second member. The second bending part extends in a direction that intersects the first partitioning plate.

Consequently, ingress of liquid, and/or small animals, and the like into the third space is inhibited by a simple configuration.

A heat source unit of a refrigerating apparatus according to a ninth aspect is the heat source unit of a refrigerating apparatus according to the eighth aspect, the first partitioning plate extending along the vertical direction. The second bending part extends along the horizontal direction directly above the first partitioning plate.

Consequently, ingress of liquid, and/or small animals, and the like into the third space is inhibited by a simple configuration.

A heat source unit of a refrigerating apparatus according to a tenth aspect is the heat source unit of a refrigerating apparatus according to the sixth aspect, a communication opening being formed in the second member. The communication opening communicates between the second air flow path and the first space. The communication opening is configured with a plurality of slits.

Consequently, ingress of liquid, and/or small animals, and the like into the third space is inhibited by a simple configuration.

DESCRIPTION OF EMBODIMENTS

A heat source unit 20 according to one embodiment of the present invention is described below. The embodiment below is a specific example of the present invention and is not a limitation of the technical scope of the present invention. Suitable modifications may be made within a scope not deviating from the gist of the invention. In the embodiment below, the directions "up," "down," "front (front face)," "back (back face)," "left," and "right" signify the directions illustrated in FIGS. 2 to 23. These directions are directions based on a main face in the condition of placement of a vertical partitioning plate 50 (to be described).

(1) Configuration of Air Conditioning Apparatus 100

Figure 1:
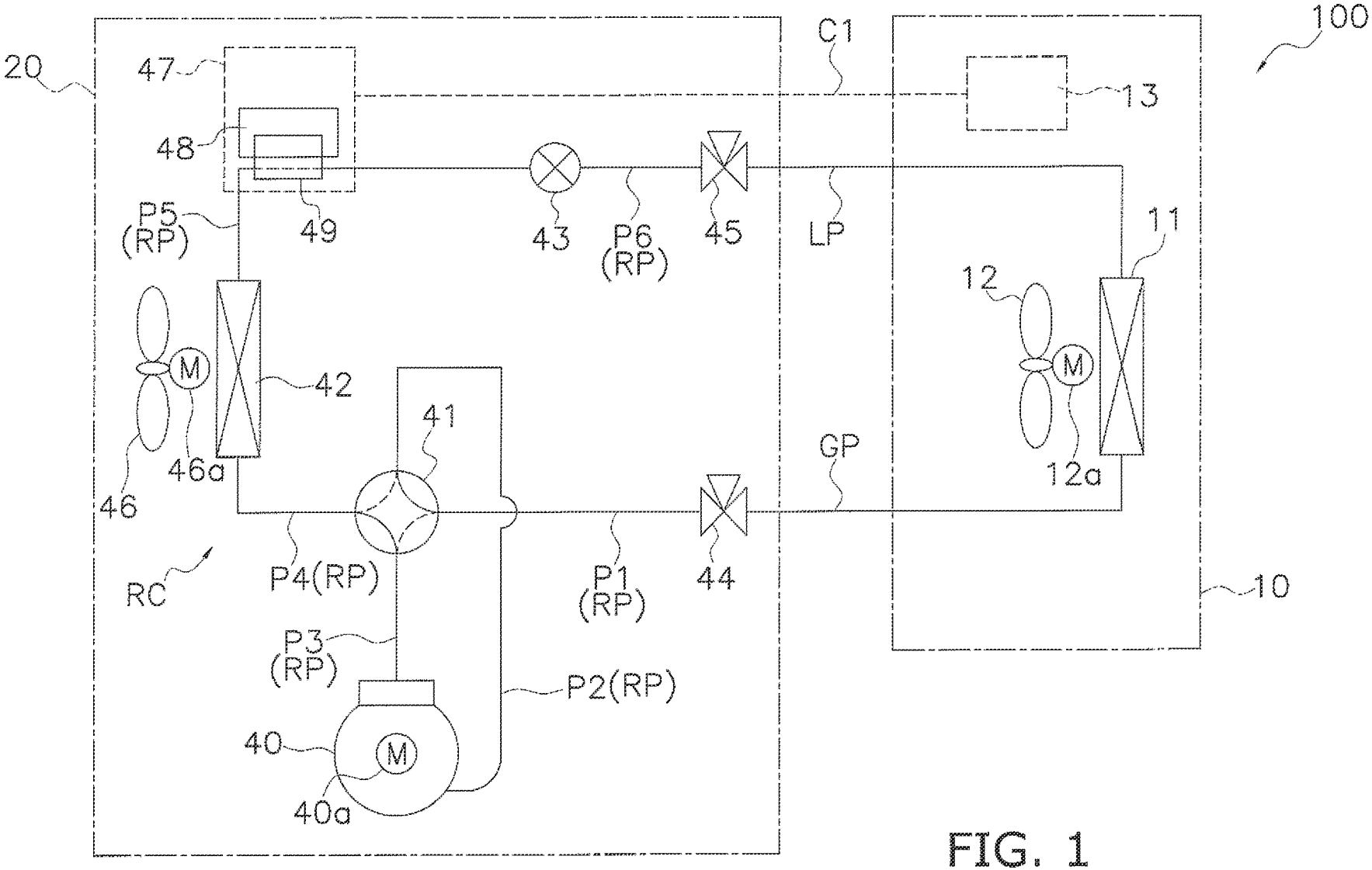
FIG. 1 is a schematic diagram of an air conditioning apparatus including a heat source unit according to one embodiment of the present invention.

FIG. 1 is a schematic diagram of an air conditioning apparatus 100 including the heat source unit 20 according to one embodiment of the present invention.

The air conditioning apparatus 100 is an apparatus for performing a cooling operation or a heating operation to realize air conditioning of a target space. Specifically, the air conditioning apparatus 100 performs a vapor compression-type refrigeration cycle. In the air conditioning apparatus 100, a refrigerant circuit RC is configured mainly by connection of a utilization unit 10 and the heat source unit 20. The utilization unit 10 and the heat source unit 20 are connected by way of a liquid refrigerant connection pipe LP and a gas refrigerant connection pipe GP.

<Utilization Unit 10>

The utilization unit 10 is placed indoors. The utilization unit 10 mainly has a utilization-side heat exchanger 11, a utilization unit blower 12, and a utilization unit controller 13.

The utilization-side heat exchanger 11 is a heat exchanger that functions as an evaporator of refrigerant during the cooling operation and functions as a condenser or a radiator of refrigerant during the heating operation. A liquid side of the utilization-side heat exchanger 11 is connected to the liquid refrigerant connection pipe LP. A gas side of the utilization-side heat exchanger 11 is connected to the gas refrigerant connection pipe GP.

The utilization unit blower 12 is a blower for generating an air flow that flows into the utilization unit 10 from outside the utilization unit 10, passes through the utilization-side heat exchanger 11, and then flows out of the utilization unit 10. The utilization unit blower 12 is connected to an output shaft of a utilization unit blower motor 12*a*, and drives in unison with operation of the utilization unit blower motor 12*a*.

The utilization unit controller 13 is a microcomputer including a CPU, memory, and/or the like. The utilization unit controller 13 is connected with a heat source unit controller 47 by way of a communication cable C1, and signals are mutually exchanged in accordance with the situation. The utilization unit 10 also exchanges signals with a remote controller (not illustrated).

<Heat Source Unit 20>

The heat source unit 20 is placed outdoors, in a basement, and/or the like. The heat source unit 20 mainly has refrigerant piping RP, a compressor 40, a four-way switching valve 41, a heat source-side heat exchanger 42, an expansion valve 43, a gas-side closing valve 44, a liquid-side closing valve 45, a heat source unit blower 46, and the heat source unit controller 47, and these machines and devices are housed inside a casing 30 (to be described).

The refrigerant piping RP that is disposed in the heat source unit 20 mainly includes a first refrigerant piping P1, a second refrigerant piping P2, a third refrigerant piping P3, a fourth refrigerant piping P4, a fifth refrigerant piping P5, and a sixth refrigerant piping P6. The first refrigerant piping P1 has one end connected to the gas-side closing valve 44 and the other end connected to the four-way switching valve 41. The second refrigerant piping P2 has one end connected to the four-way switching valve 41 and the other end connected to the intake opening of the compressor 40. The third refrigerant piping P3 has one end connected to the discharge opening of the compressor 40 and the other end connected to the four-way switching valve 41. The fourth refrigerant piping P4 has one end connected to the four-way switching valve 41 and the other end connected to the heat source-side heat exchanger 42. The fifth refrigerant piping P5 has one end connected to the heat source-side heat exchanger 42 and the other end connected to the expansion valve 43. The fifih refrigerant piping P5 passes through a heat sink 49 (described below) on its way from one end to the other end. The sixth refrigerant piping P6 has one end connected to the expansion valve 43 and another end connected to the liquid-side closing valve 45.

The compressor 40 is a machine for compressing a refrigerant. The compressor 40 drives in unison with operation of a compressor motor 40*a*. The compressor motor 40*a* is a motor of a type in which a frequency (rotation rate) is controllable by an inverter. The compressor 40 is configured so that an operating capacity can be controlled by varying the frequency (rotation rate).

The four-way switching valve 41 is a switching valve for switching the direction of flow of the refrigerant in the refrigerant circuit RC. In the present embodiment, the four-way switching valve 41 is a four-way valve connected to the first refrigerant piping P1, the second refrigerant piping P2, the third refrigerant piping P3, and the fourth refrigerant piping P4. The four-way switching valve 41 connects the first refrigerant piping P1 and the second refrigerant piping P2 and connects the third refrigerant piping P3 and the fourth refrigerant piping P4 during the cooling operation (see the solid line of the four-way switching valve 41 in FIG. 1). The four-way switching valve 41 connects the first refrigerant piping P1 and the third refrigerant piping P3 and connects the second refrigerant piping P2 and the fourth refrigerant piping P4 during the heating operation (see the broken line of the four-way switching valve 41 in FIG. 1).

The heat source-side heat exchanger 42 is a heat exchanger that functions as a condenser or a radiator of refrigerant during the cooling operation and functions as an evaporator of refrigerant during the heating operation. A gas side of the heat source-side heat exchanger 42 is connected to the fourth refrigerant piping P4. A liquid side of the heat source-side heat exchanger 42 is connected to the fifth refrigerant piping P5. The configuration of the heat source-side heat exchanger 42 is to be described.

The expansion valve 43 is a valve for depressurizing a high-pressure refrigerant. The expansion valve 43 depressurizes the high-pressure refrigerant that are condensed or radiated in the heat source-side heat exchanger 42. The expansion valve 43 depressurizes the high-pressure refrigerant that are condensed or radiated in the utilization-side heat exchanger 11 during the heating operation.

The gas-side closing valve 44 and the liquid-side closing valve 45 are manually-operated valves that are closed during pump down, or the like. One end of the gas-side closing valve 44 is connected to the gas refrigerant connection pipe GP, and the other end is connected to the first refrigerant piping P1. One end of the liquid-side closing valve 45 is connected to the liquid refrigerant connection pipe LP, and the other end is connected to the sixth refrigerant piping P6.

The heat source unit blower 46 is, for example, a propeller fan or other blower. The heat source unit blower 46 generates an air flow that flows into the casing 30 from outside the casing 30, passes through the heat source-side heat exchanger 42, and then flows out of the casing 30 by way of a vent 321. The heat source unit blower 46 is connected to an output shaft of a heat source unit blower motor 46*a*, and drives in unison with operation of the heat source unit blower motor 46*a*.

The heat source unit controller 47 controls operation of the actuators, which are contained in the heat source unit 20, such as the compressor motor 40*a*. The heat source unit controller 47 is a unit, which has a microcomputer including a CPU, memory, and/or the like, and other electrical component such as an inverter, is mounted on a substrate 47*a*. A heat-generating part 48 such as a power element that generates heat by electrical conduction is included in the electrical component included in the heat source unit controller 47. A heat sink 49 is provided on the substrate 47*a* in order to cool the heat-generating part 48.

The heat sink 49 is a heat exchanger that cools the heat-generating part 48 with refrigerant that circulates through the refrigerant circuit RC (in this case, refrigerant flowing through the fifth refrigerant piping P5). Specifically, the heat sink 49 functions as a heat exchanger that cools the heat-generating part 48 with refrigerant that has passed through the heat source-side heat exchanger 42 during the cooling operation. The heat sink 49 functions as a heat exchanger for cooling the heat-generating part 48 with refrigerant that has passed through the expansion valve 43 during the heating operation.

(2) Details of the Heat Source Unit 20 and Parts Disposed Inside the Heat Source Unit 20

Figure 2:
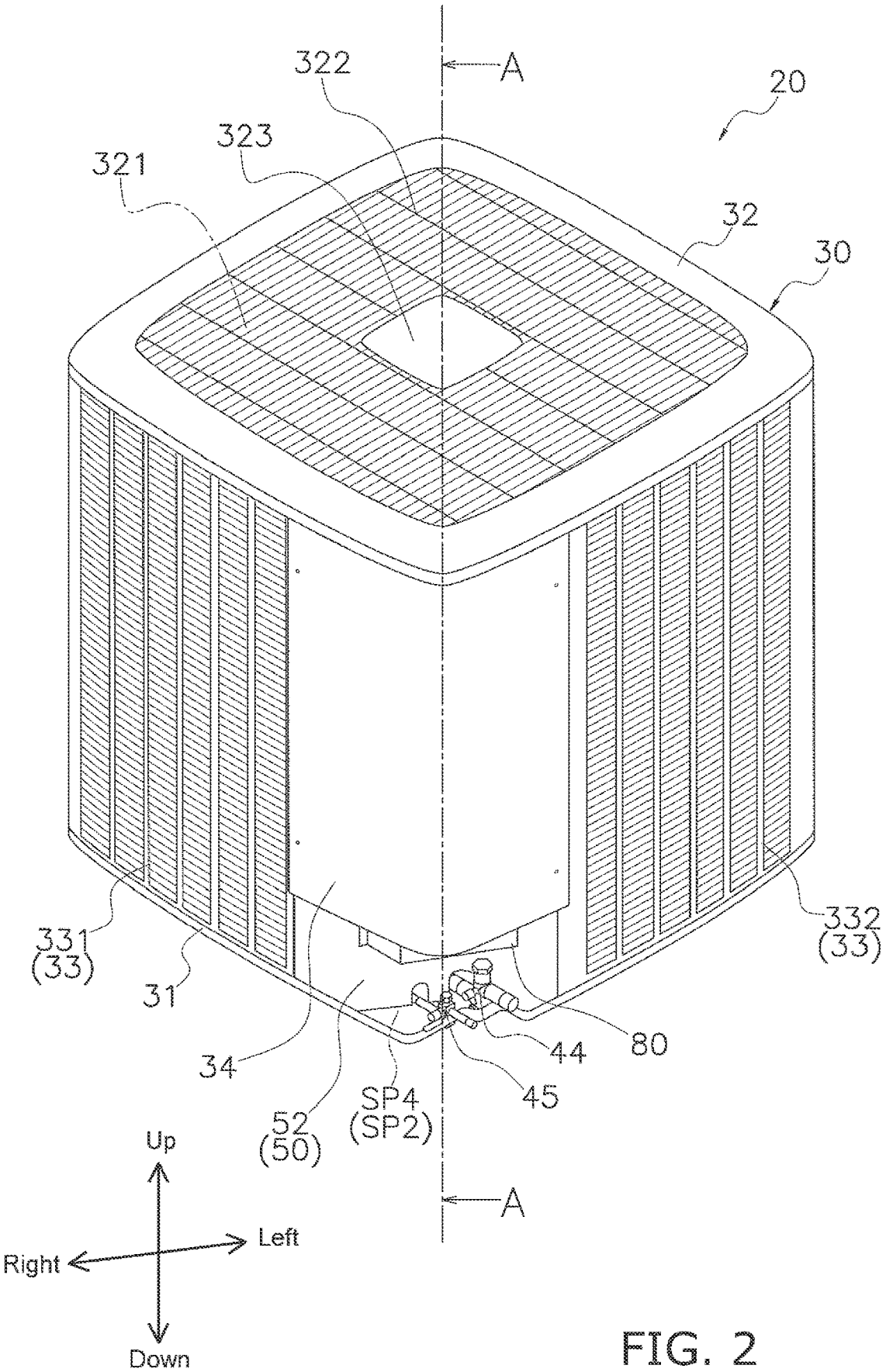
FIG. 2 is an external perspective view showing a heat source unit according to one embodiment of the present invention.
Figure 3:
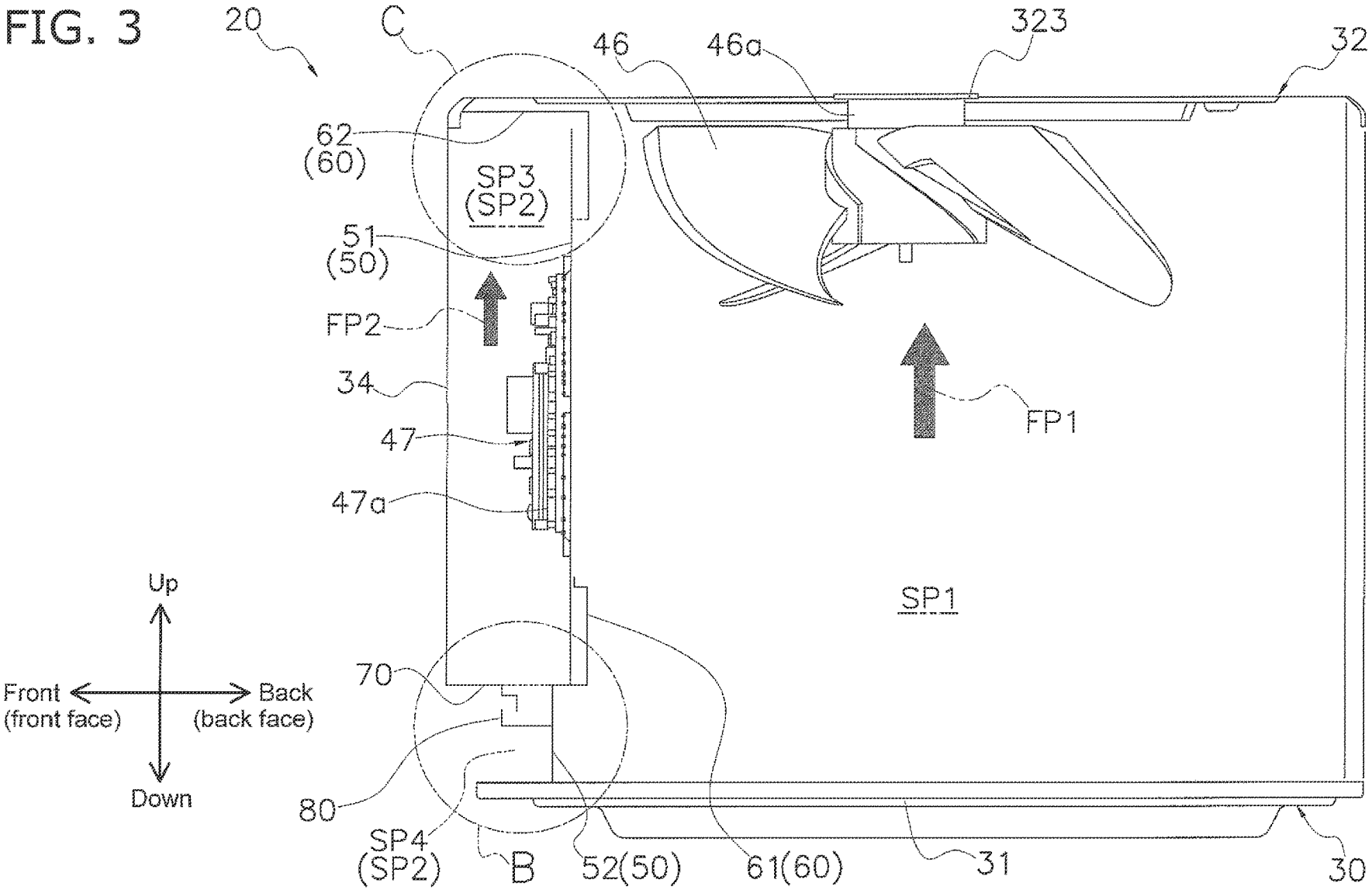
FIG. 3 is a sectional view across line A-A in FIG. 2 (some machines and devices housed inside a casing are not illustrated).
Figure 4:
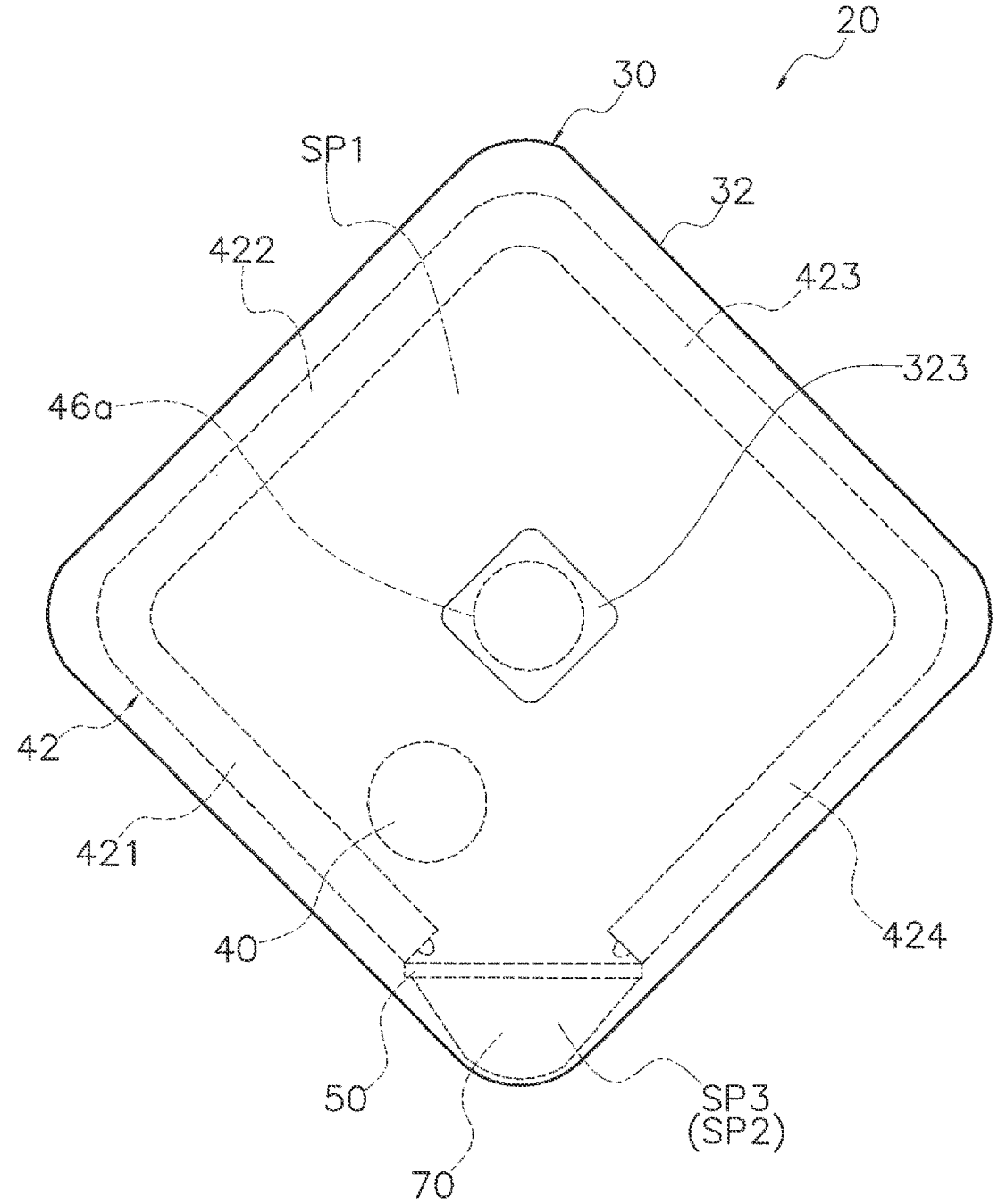
FIG. 4 is a diagram typically illustrating the heat source unit viewed from above.
Figure 4:
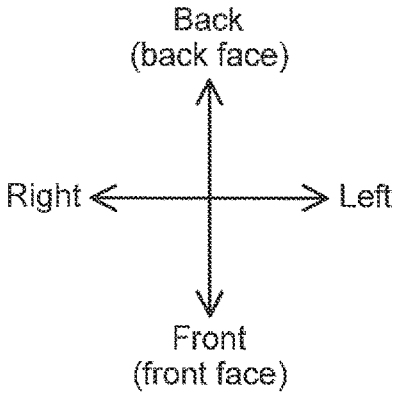

The heat source unit 20 and various parts disposed inside the heat source unit 20 shall now be described in detail. FIG. 2 is an external perspective view of the heat source unit 20 according to one embodiment of the present invention. FIG. 3 is a sectional view across line A-A in FIG. 2 (some machines and devices housed inside the casing 30 are not illustrated). FIG. 4 is a diagram typically illustrating the heat source unit 20 viewed from above.

<Casing 30>

The outer boundary of the heat source unit 20 is constituted by the casing 30 that is shaped as a roughly rectangular. Various devices are housed inside the casing 30. In addition, a vertical partitioning plate 50, a guard member 60, and a horizontal partitioning plate 70 are disposed inside the casing 30. The vertical partitioning plate 50, the guard member 60, and the horizontal partitioning plate 70 are described below. The casing 30 primarily includes a bottom plate 31, a ceiling plate 32, a side face grill 33, and a corner cover 34.

The bottom plate 31 is a roughly square plate-form member configuring a bottom face portion of the casing 30. A lower partitioning plate 52 (to be described) is placed on top of the bottom plate 31. A plurality of ribs (not illustrated) is formed on the bottom plate 31 for the purpose of forming drainage channels for drain water, enhancing strength of the bottom plate 31, and/or other purposes.

The ceiling plate 32 is a roughly square plate-form member configuring a top face portion of the casing 30. The ceiling plate 32 has a large opening functioning as the vent 321. The reason why the vent 321 is formed in the ceiling plate 32 is because the direction of venting air is upward in the heat source unit 20. That is, the heat source unit 20 is configured so as to vent air upward by way of the vent 321 after having taken air into the casing 30 from four side faces during operation. A lattice-form member 322 is provided on the vent 321 for the purpose of preventing articles from falling in, or the like. The lattice-form member 322 configures a portion of the ceiling plate 32. A motor installation part 323, which is shaped as a plate, is provided in the center portion of the ceiling plate 32. The motor installation part 323 configures a portion of the ceiling plate 32. The heat source unit blower motor 46*a* is fixed on the lower face side of the motor installation part 323. That is, the heat source unit blower motor 46*a* is fixed to the ceiling plate 32.

The side face grill 33 is a lattice-form member configuring four side faces of the casing 30. The side face grill 33 includes a first side face grill 331 and a second side face grill 332. The first side face grill 331 configures one side face among the four side faces of the casing 30, and the second side face grill 332 configures another one side face. More specifically, the second side face grill 332 configures a side face adjacent to the side face configured by the first side face grill 331.

The corner cover 34 is a plate-form member that covers an upper corner space SP3 described below (specifically, a part of the corner formed by the side face constituted by the first side face grill 331 and the side face constituted by the second side face grill 332). The corner cover 34 is a roughly L-shaped or V-shaped plate-form member as seen from a plan view. The corner cover 34 is fixed to the first side face grill 331 and the second side face grill 332 with screws. The corner cover 34 shields the upper corner space SP3 from the outside.

<Heat Source-Side Heat Exchanger 42>

Figure 5:
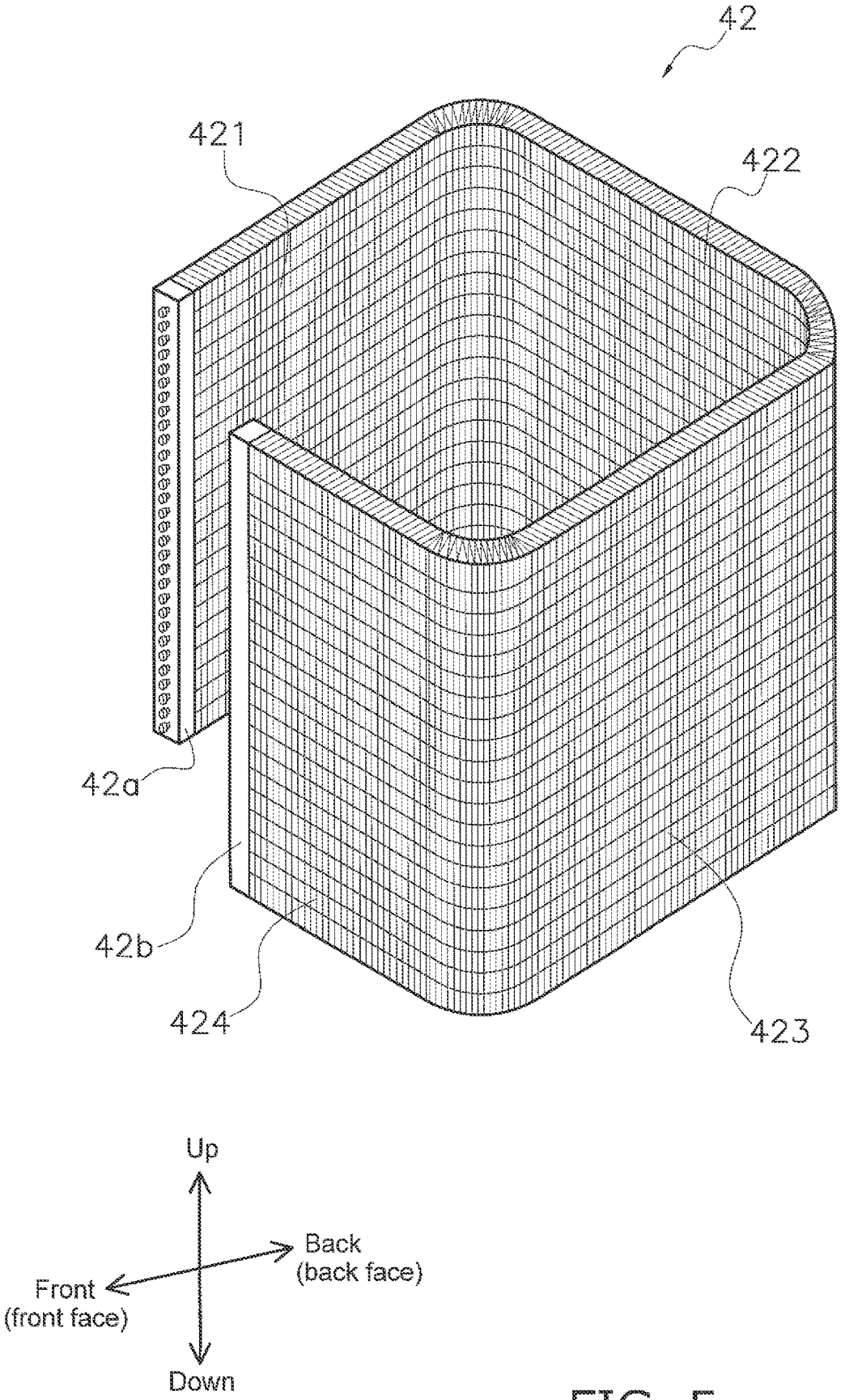
FIG. 5 is an external perspective view of a heat source-side heat exchanger.

FIG. 5 is an external perspective view of the heat source-side heat exchanger. The heat source-side heat exchanger 42 is a fin-and-tube heat exchanger including a plurality of heat-transmitting tubes and a plurality of fins. The heat source-side heat exchanger 42 has four side face parts facing the side faces of the casing 30, and two tube plates. Specifically, the heat source-side heat exchanger 42 has a first side face part 421, a second side face part 422, a third side face part 423, a fourth side face part 424, a first tube plate 42*a*, and a second tube plate 42*b*.

The first side face part 421 faces the side face configured by the first side face grill 331. The second side face part 422 faces a side face adjacent to the side face configured by the first side face grill 331. That is, the second side face part 422 is adjacent to the first side face part 421. The third side face part 423 faces a side face opposite the side face faced by the first side face part 421 and adjacent to the side face faced by the second side face part 422. That is, the third side face part 423 is opposite the first side face part 421 and adjacent to the second side face part 422. The fourth side face part 424 faces the side face configured by the second side face grill 332. The fourth side face part 424 also faces a side face opposite the side face faced by the second side face part 422 and adjacent to the side face faced by the third side face part 423. That is, the fourth side face part 424 is opposite the second side face part 422 and adjacent to the third side face part 423. The fourth side face part 424 is not adjacent to the first side face part 421.

The first tube plate 42*a* is fixed to an end of the first side face part 421. The second tube plate 42*b* is fixed to an end of the fourth side face part 424. Screw holes (not shown in the drawings) for fixing the vertical partitioning plate 50 (described below) and the guard member 60 (described below) are formed in the first tube plate 42*a* and the second tube plate 42*b*.

As shown in FIG. 4 and FIG. 5, in the heat source-side heat exchanger 42, an end of the first side face part 421 (specifically, the first tube plate 42*a*) constitutes an end of the heat source-side heat exchanger 42, and an end of the fourth side face part 424 (specifically, the second tube plate 42*b*) constitutes another end of the heat source-side heat exchanger 42. There is a space between the end of the first side face part 421 and the end of the fourth side face part 424, and the vertical partitioning plate 50 and the horizontal partitioning plate 70 are disposed in this space.

<Middle Space SP1 and Corner Space SP2>

In the interior of the casing 30, the vertical partitioning plate 50 (equivalent to "first partitioning plate" in the claims) is disposed, extending along the vertical direction. Details concerning the vertical partitioning plate 50 are described below. By disposing the vertical partitioning plate 50 inside the casing 30, two spaces are formed. Specifically, the space that is formed in the back face side of the vertical partitioning plate 50 is a middle space SP1 (equivalent to "first space" in the claims). In addition, the space that is formed in the front face side of the vertical partitioning plate 50 is a corner space SP2 (equivalent to "second space" in the claims).

The middle space SP1, as shown in FIG. 3 and FIG. 4, is a space that takes up most of the interior of the casing 30. Specifically, the middle space SP1 is surrounded by the heat source-side heat exchanger 42 (specifically, the first side face part 421, the second side face part 422, the third side face part 423, and the fourth side face part 424), and the vertical partitioning plate 50. The actuators such as the compressor 40 and the heat source unit blower 46, the refrigerant piping RP, and/or the like, are disposed in the middle space SP1.

As shown in FIG. 4, the corner space SP2 is a space that is formed in a corner formed toward the front face among the four corners of the casing 30. In other words, the corner space SP2 is formed in the corner portion that is formed by the side face that is constituted by the first side face grill 331 and the side face that is constituted by the second side face grill 332. The corner space SP2 is partitioned from the middle space SP1 by the vertical partitioning plate 50.

The horizontal partitioning plate 70 (equivalent to "second partitioning plate" in the claims) is disposed in the corner space SP2. The horizontal partitioning plate 70 extends along the horizontal direction. The details of the horizontal partitioning plate 70 are described below. In the corner space SP2, two spaces are formed by disposition of the horizontal partitioning plate 70. Specifically, the space that is formed above the horizontal partitioning plate 70 is the upper corner space SP3 (equivalent to "third space" in the claims). The space that is formed below the horizontal partitioning plate 70 is a lower corner space SP4 (equivalent to "fourth space" in the claims). Specifically, the corner space SP2 is divided by the horizontal partitioning plate 70 into the upper corner space SP3 and the lower corner space SP4.

The upper corner space SP3 is surrounded by the corner cover 34, the vertical partitioning plate 50, and the horizontal partitioning plate 70. The substrate 47*a* on which the heat source unit controller 47 has been mounted is disposed in the upper corner space SP3. In addition, the fifth refrigerant piping P5 extends from the middle space SP1 in order to pass through the heat sink 49 into the upper corner space SP3. The fifth refrigerant piping P5 extends upwards and downwards (in the vertical direction) and adjoins the vertical partitioning plate 50 in the upper corner space SP3.

The lower corner space SP4 is situated below the upper corner space SP3, and is exposed outwards from the casing 30. The tower corner space SP4 is partitioned from the middle space SP1 by the vertical partitioning plate 50. A lower air flow path-forming member 80 (equivalent to "first member" in the claims) is disposed directly below the horizontal partitioning plate 70 in the lower corner space SP4. Details concerning the lower air flow path-forming member 80 are described below. The first refrigerant piping P1 and the sixth refrigerant piping P6 extend from the middle space SP1 into the lower corner space SP4 via a piping opening 52*a* formed in the vertical partitioning plate 50. The gas-side closing valve 44 that is connected to the first refrigerant piping P1 and the liquid-side closing valve 45 that is connected to the sixth refrigerant piping P6 are disposed below the lower air flow path-forming member 80 in the lower corner space SP4.

<Vertical Partitioning Plate 50>

Figure 6:
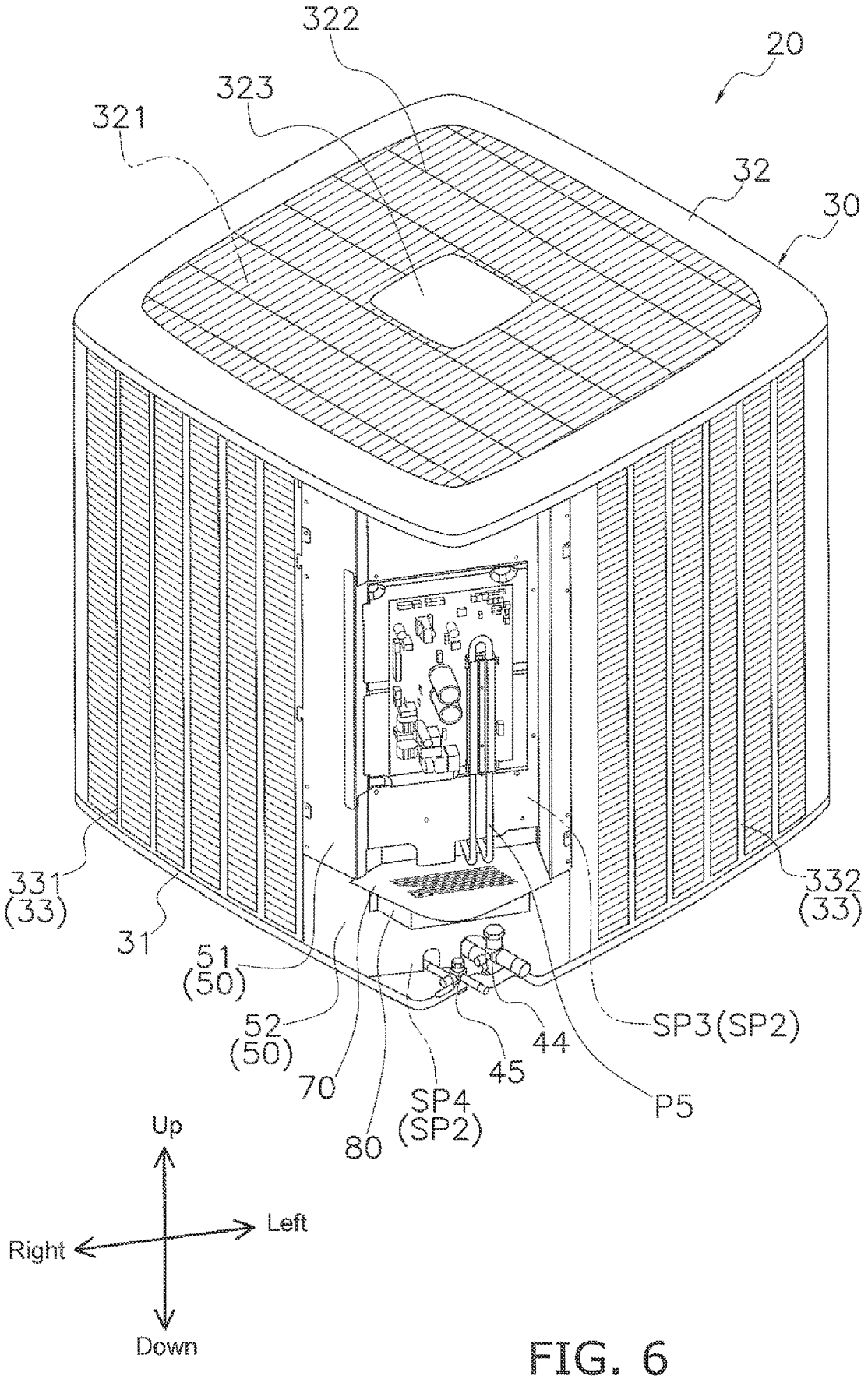
FIG. 6 is an external perspective view of the heat source unit in a condition having removed a corner cover.

FIG. 6 is an external perspective view of the heat source unit 20 in a condition having removed the corner cover 34. The heat source unit 20 has the vertical partitioning plate 50 extending along the vertical direction inside the casing 30. "Extending along the vertical direction" includes not only the case of extending strictly in the vertical direction, but also the case of extending slightly tilted toward the vertical direction. Specifically, it is understood as that the vertical partitioning plate 50 extends along the vertical direction if the angle between the vertical partitioning plate 50 and the vertical line is 0° to within 30° viewed from the side.

As shown in FIG. 4, the vertical partitioning plate 50 is disposed between the end of the first side face part 421 and the end of the fourth side face part 424. As shown in FIG. 6, with the heat source unit 20, when the corner cover 34 is removed, the vertical partitioning plate 50 and the substrate 47*a* that is fixed to the vertical partitioning plate 50 are exposed. The vertical partitioning plate 50 includes an upper partitioning plate 51 and a lower partitioning plate 52. The upper partitioning plate 51 and the lower partitioning plate 52 are separable.

Figure 7:
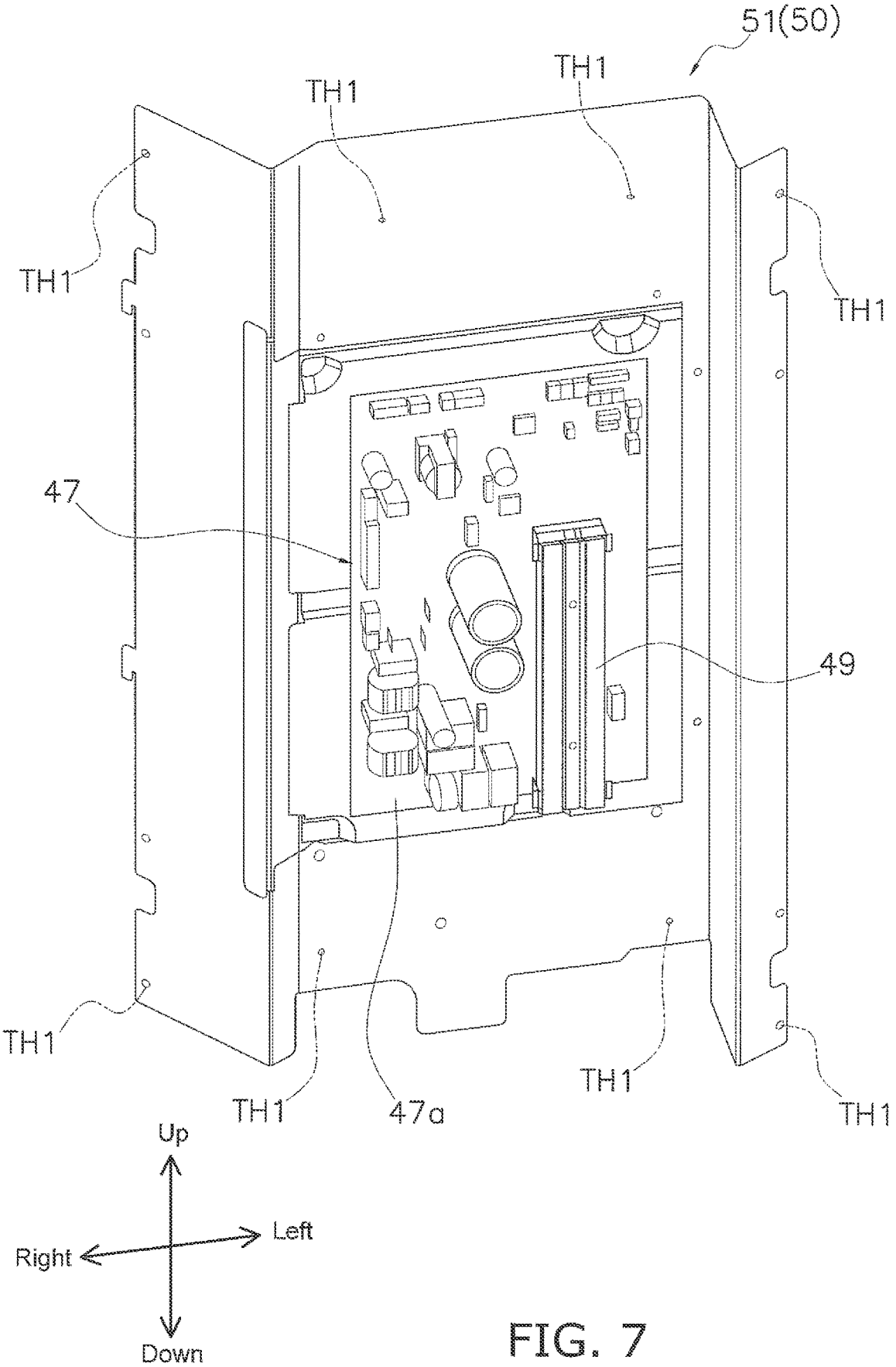
FIG. 7 is an external view of an upper partitioning plate in a state having a substrate fixed.
Figure 8:
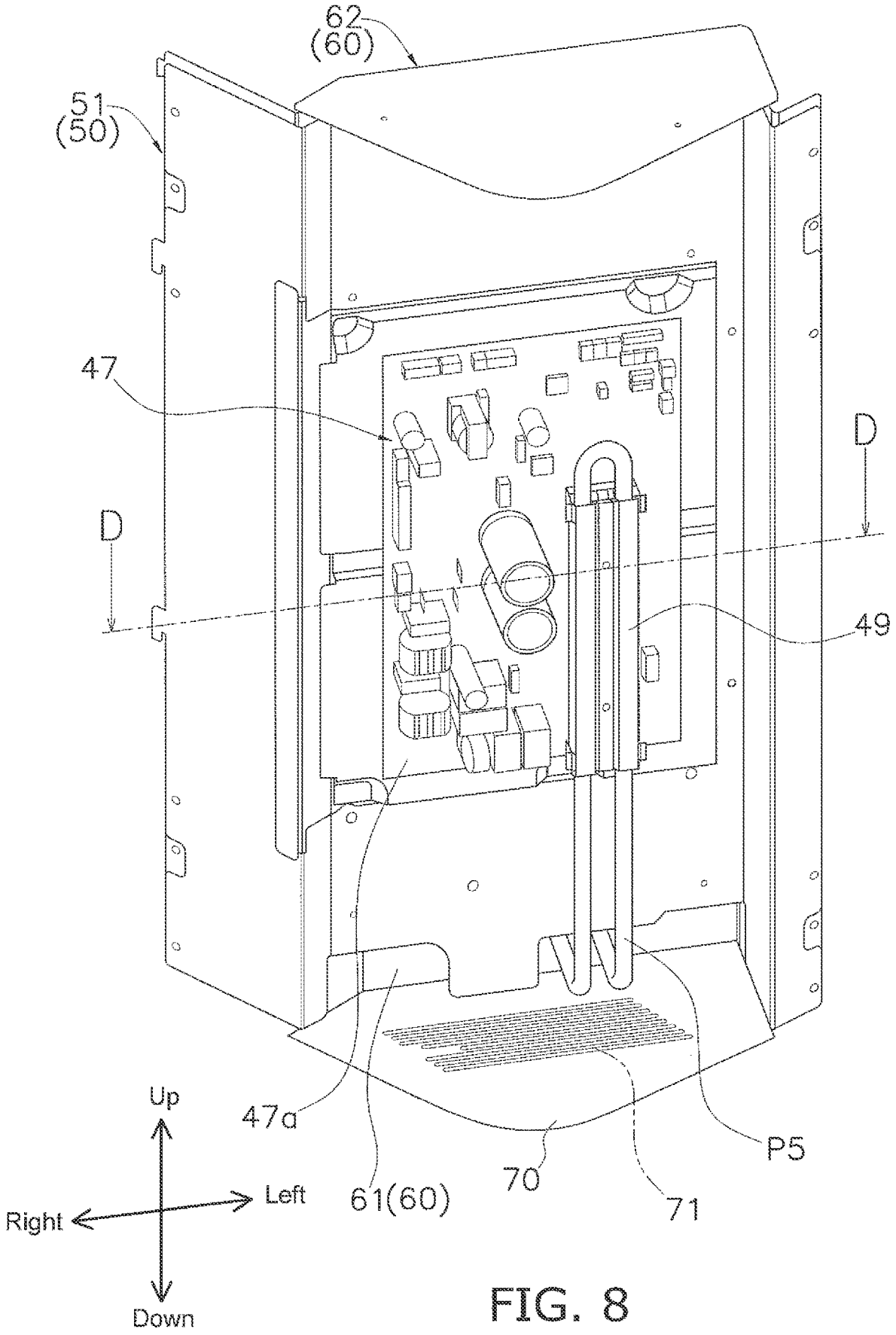
FIG. 8 is an enlarged view showing the upper partitioning plate, a guard member, and a horizontal partitioning plate in FIG. 6.
Figure 9:
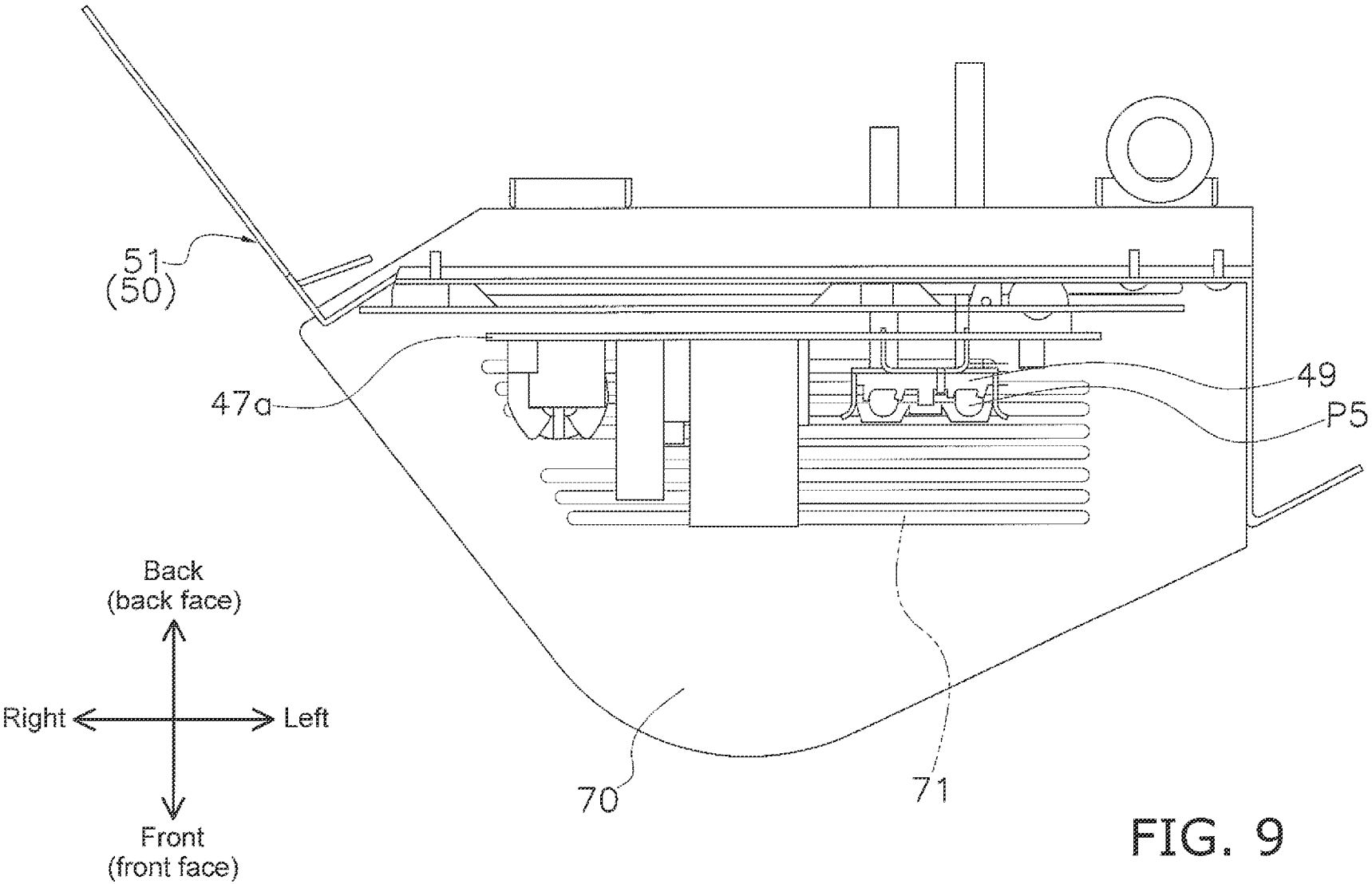
FIG. 9 is a sectional view across line D-D in FIG. 8.

FIG. 7 is an external view of the upper partitioning plate 51 with the substrate 47*a* fixed. FIG. 8 is an enlarged view showing the upper partitioning plate 51, the guard member 60, and the horizontal partitioning plate 70 in FIG. 6. FIG. 9 is a sectional view across line D-D in FIG. 8.

The upper partitioning plate 51 is a plate-form member that constitutes the upper portion of the vertical partitioning plate 50. The upper partitioning plate 51 is disposed between the middle space SP1 and the upper corner space SP3. The upper partitioning plate 51 partitions the upper corner space SP3 from the middle space SP1. A plurality of screw holes TH1 are formed in the upper partitioning plate 51. The upper partitioning plate 51 is fixed by screws to the first tube plate 42*a* and the second tube plate 42*b* via the screw holes TH1. The substrate 47*a* on which the heat source unit controller 47 has been mounted is fixed in the middle portion of the upper partitioning plate 51.

The heat sink 49 is provided on the substrate 47*a*. The fifth refrigerant piping P5 is fitted on the heat sink 49. The heat sink 49 is a member that is vertically elongated. The heat sink 49 is disposed so that it covers, from the front face, the heat-generating part 48 that have been mounted on the substrate 47*a*. The heat sink 49 is in thermal contact with the heat-generating part 48. A part of the fifth refrigerant piping P5 is contained inside the heat sink 49.

Figure 10:
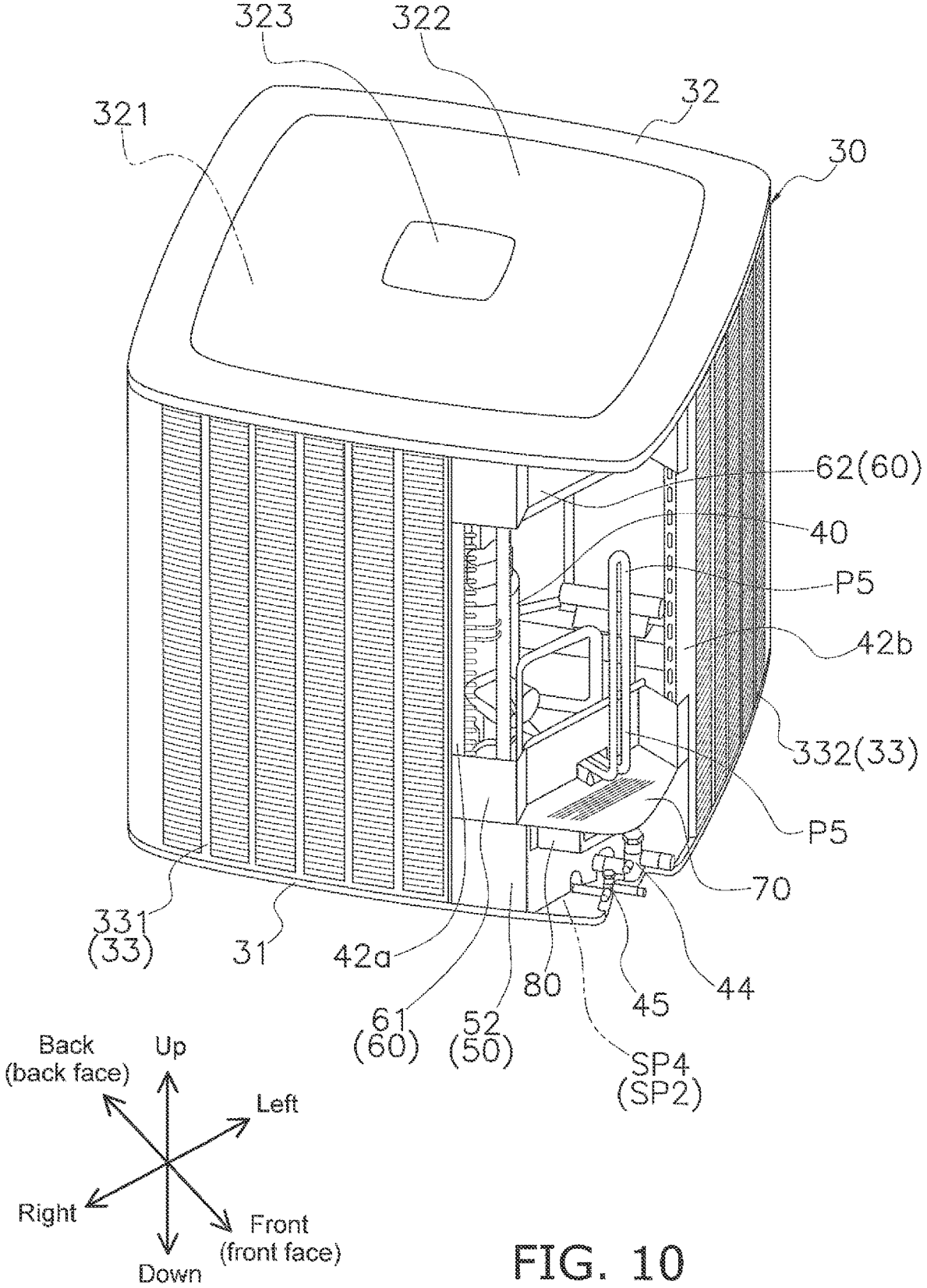
FIG. 10 is an external perspective view of the heat source unit with the upper partitioning plate having been removed from the heat source unit in the state shown in FIG. 6.
Figure 11:
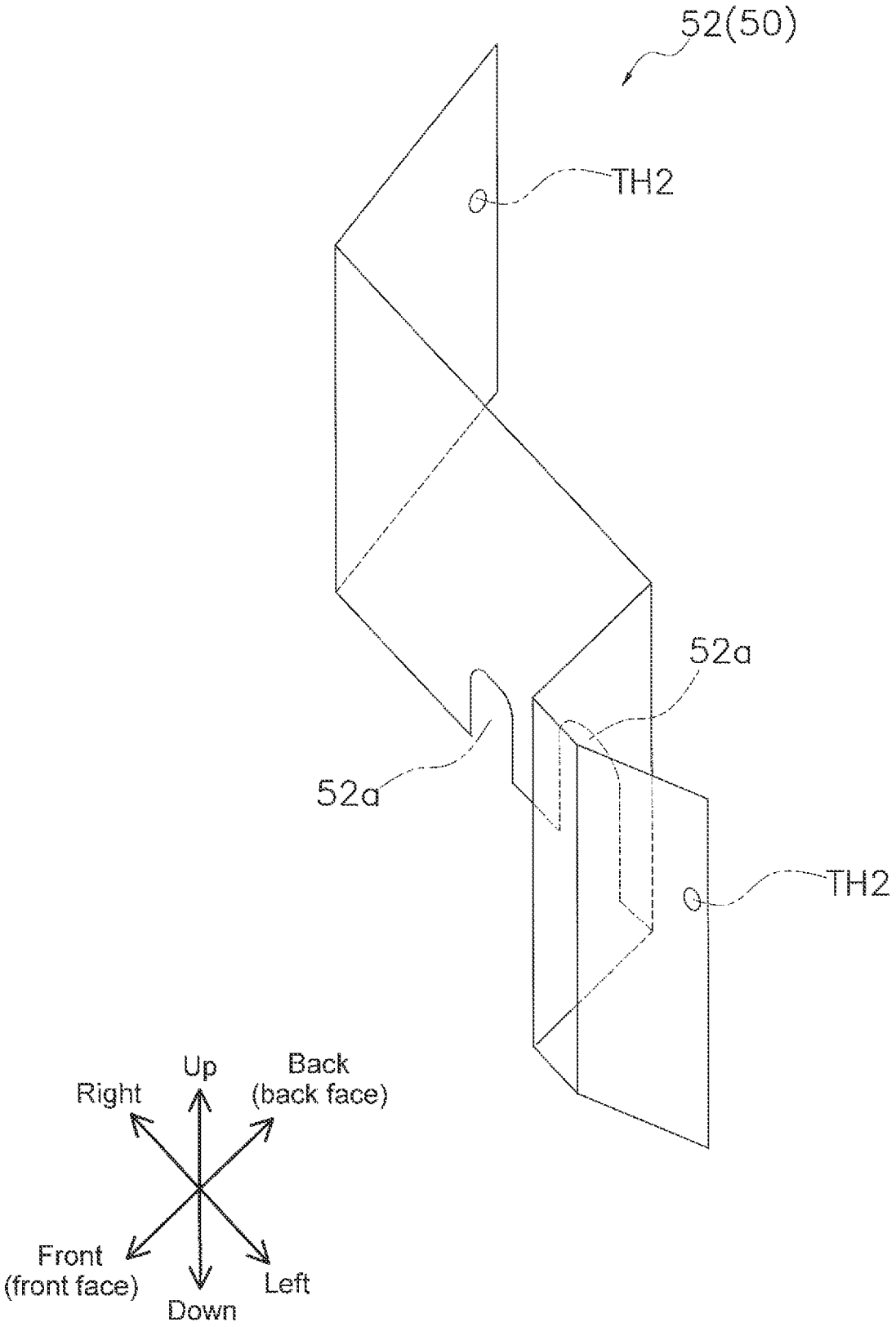
FIG. 11 is a perspective view of a lower partitioning plate viewed from the front face side.
Figure 12:
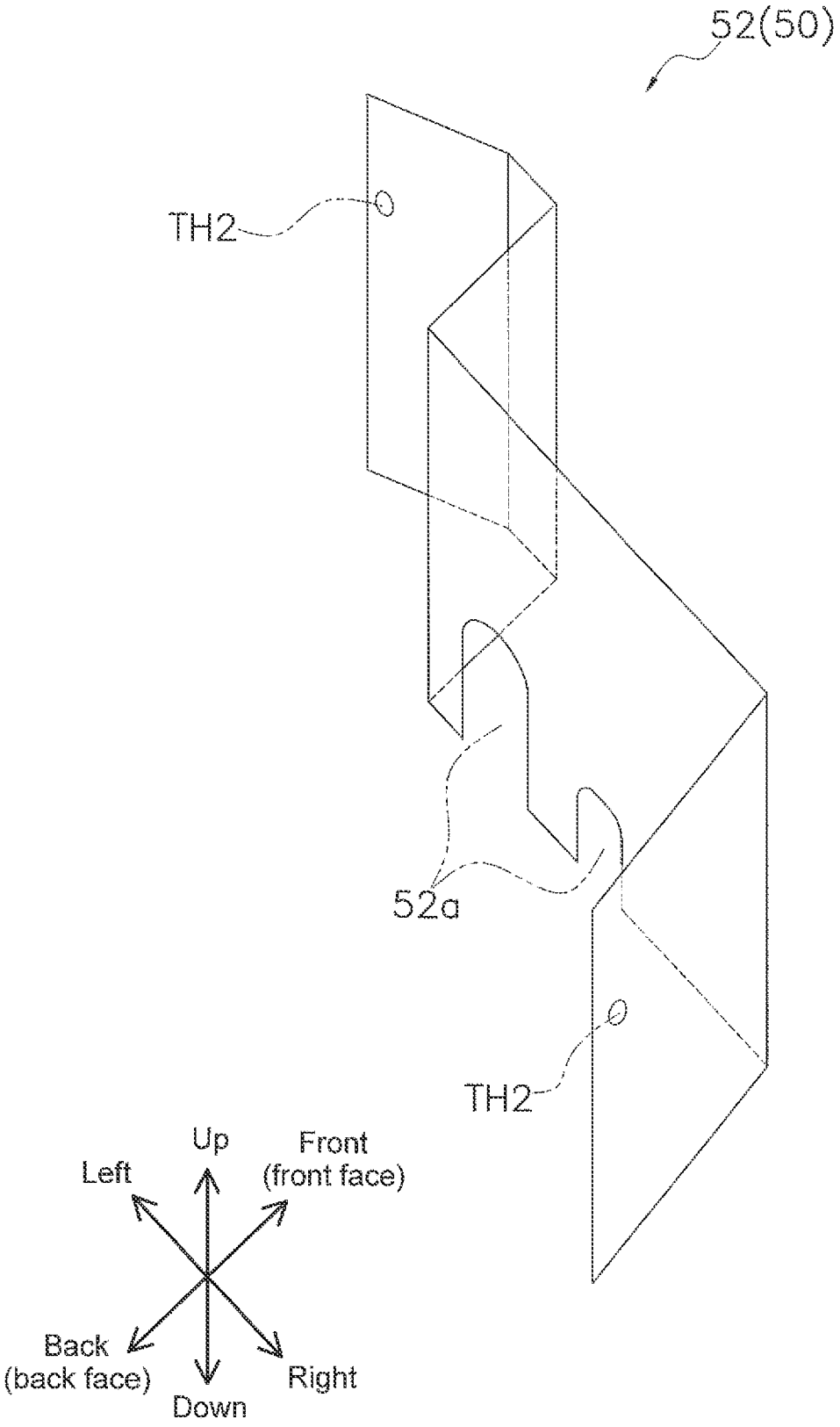
FIG. 12 is a perspective view of the lower partitioning plate viewed from the back face side.

FIG. 10 is an external perspective view of the heat source unit 20 with the upper partitioning plate 51 having been removed from the unit in the state shown in FIG. 6. FIG. 11 is a perspective view of the lower partitioning plate 52 viewed from the front face side. FIG. 12 is a perspective view of the lower partitioning plate 52 viewed from the back face side.

The lower partitioning plate 52 is a plate-form member that constitutes the lower portion of the vertical partitioning plate 50. The lower partitioning plate 52, in the region below the horizontal partitioning plate 70, is disposed between the middle space SP1 and the lower corner space SP4. The lower partitioning plate 52 partitions the middle space SP1 and the lower corner space SP4. A plurality of screw holes TH2 are formed in the lower partitioning plate 52. The lower partitioning plate 52 is fixed by screws to the first tube plate 42*a* and the second tube plate 42*b* via the screw holes TH2. The piping opening 52*a* is formed in the middle portion of the lower partitioning plate 52. The piping opening 52*a* is an opening for the first refrigerant piping P1 and the sixth refrigerant piping P6 to extend from the middle space SP1 into the lower corner space SP4.

<Guard Member 60>

The guard member 60 is a member for inhibiting ingress of liquid or the like from above and below the upper partitioning plate 51 into the upper corner space SP3. The guard member 60 is disposed before the upper partitioning plate 51 is disposed. Specifically, the guard member 60 includes a lower member 61 that is disposed below the upper partitioning plate 51 and an upper member 62 that is disposed above the upper partitioning plate 51.

Figure 13:
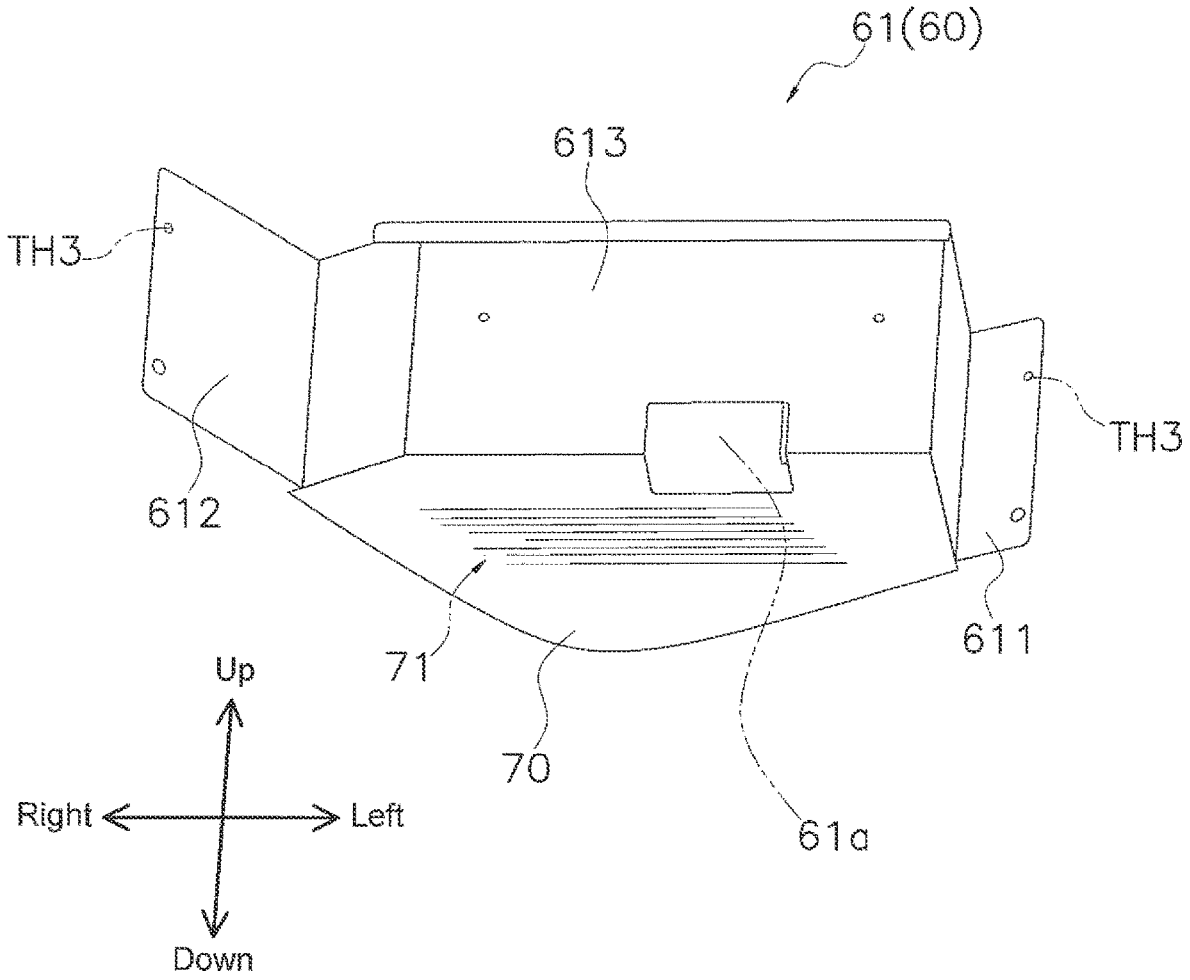
FIG. 13 is a front perspective view of a lower member and the horizontal partitioning plate.
Figure 14:
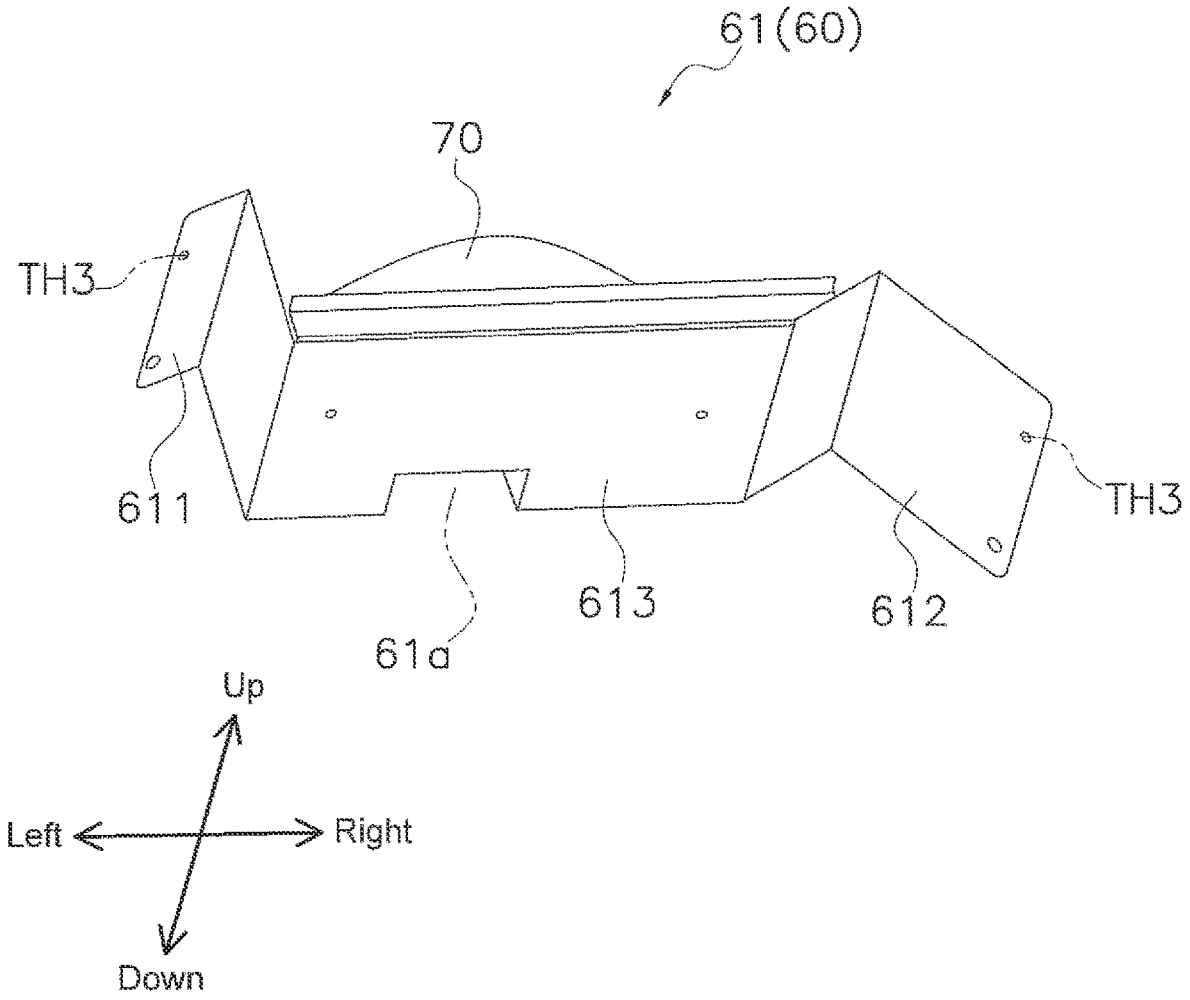
FIG. 14 is a back perspective view of the lower member.

FIG. 13 is a front perspective view of the lower member 61 and the horizontal partitioning plate 70. FIG. 14 is a back perspective view of the lower member 61. The lower member 61 is a member for inhibiting ingress of liquid or the like from below the upper partitioning plate 51 into the upper corner space SP3. A plurality of screw holes TH3 are formed in the lower member 61. The lower member 61 is fixed with screws to the heat source-side heat exchanger 42 via the screw holes TH3. The lower member 61 includes a left lower part 611, a right lower part 612, and a middle lower part 613.

The left lower part 611 is a plate-shaped portion that constitutes the left end of the lower member 61. The left lower part 611 is fixed with screws to the second tube plate 42*b*. The right lower part 612 is a plate-shaped portion that constitutes the right end of the lower member 61. The right lower part 612 is fixed with screws to the first tube plate 42*a*.

The middle lower part 613 is situated between the left lower part 611 and the right lower part 612. The middle lower part 613 is a portion that constitutes the middle portion of the lower member 61. The horizontal partitioning plate 70 extends along the horizontal direction from the middle lower part 613. Details concerning the horizontal partitioning plate 70 are described below. A refrigerant piping opening 61*a* is formed from the middle lower part 613 up to the horizontal partitioning plate 70. The refrigerant piping opening 61*a* is formed for the fifth refrigerant piping P5 to extend from the middle space SP1 to the upper corner space SP3.

Figure 15:
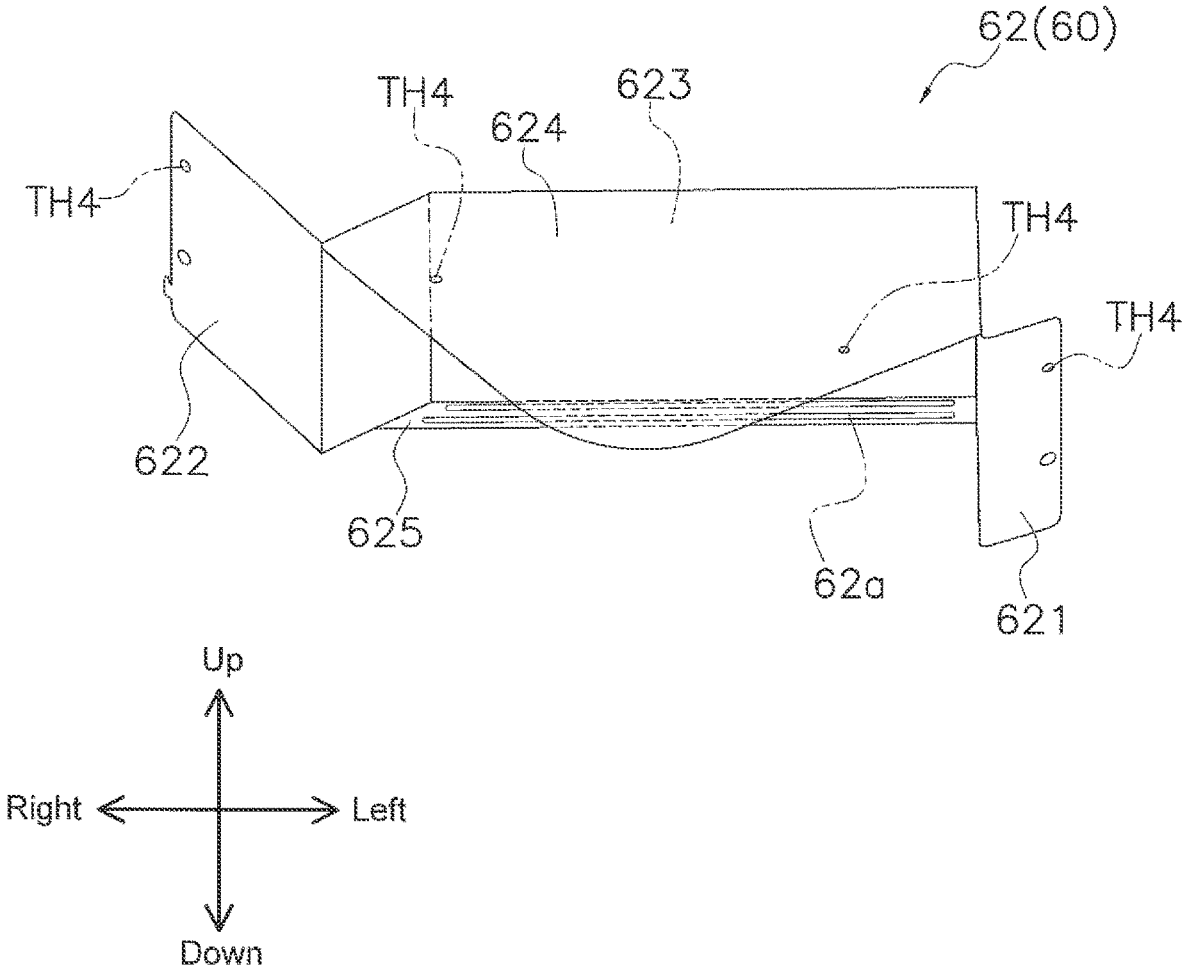
FIG. 15 is a front perspective view of an upper mentber.
Figure 16:
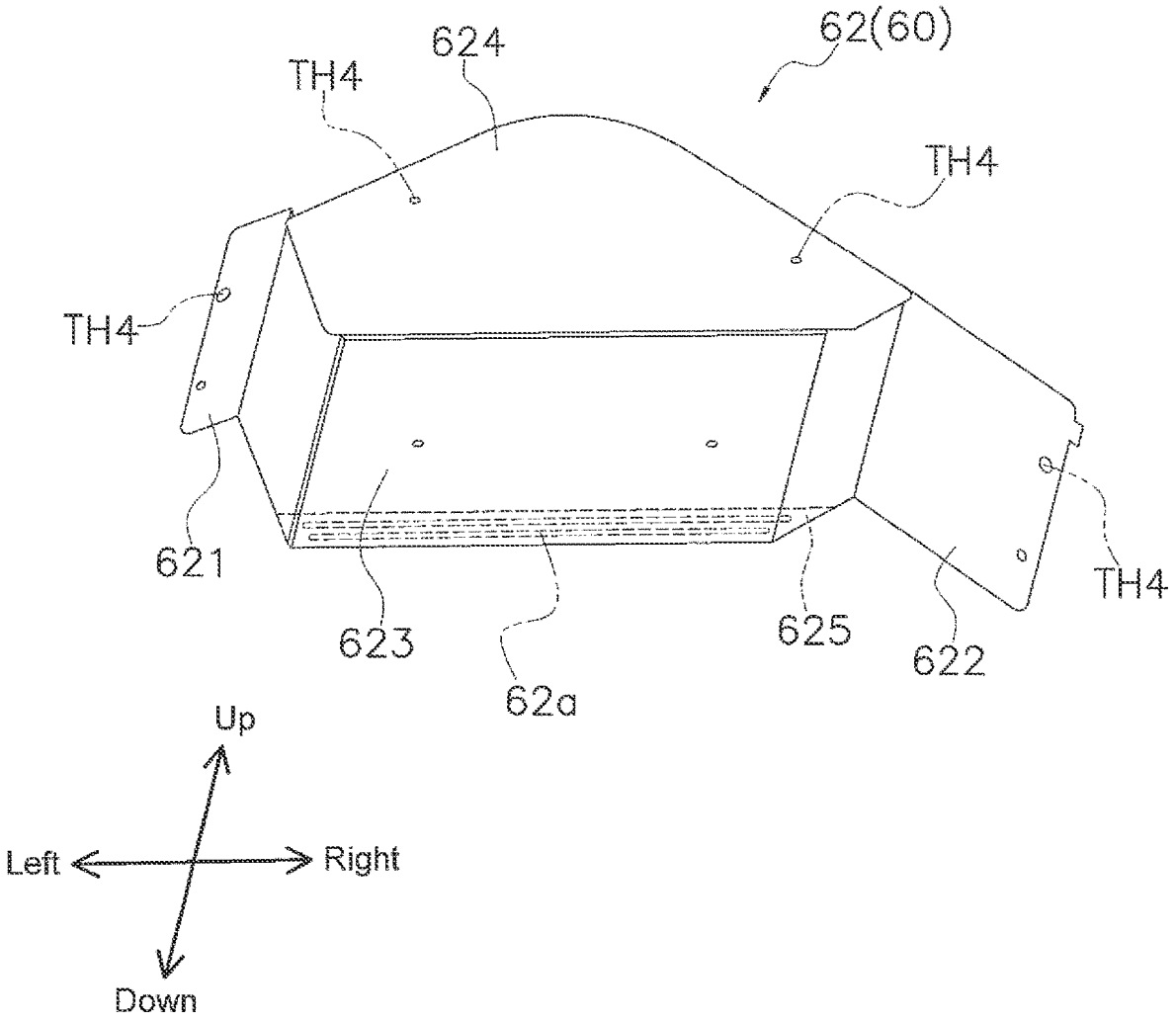
FIG. 16 is a back perspective view of the upper member.

FIG. 15 is a front perspective view of the upper member 62. FIG. 16 is a back perspective view of the upper member 62. The upper member 62 (equivalent to "second member" in the claims) is a member for inhibiting ingress of liquid or the like from above the upper partitioning plate 51 to the upper corner space SP3. In addition, the upper member 62 is a member for forming an upper air path FP4 (equivalent to "second air flow path" in the claims) that communicates between the middle space SP1 and the upper corner space SP3. Details concerning the upper air path FP4 are described below.

The upper member 62 is situated between the ceiling plate 32 and the upper corner space SP3. A part of the upper member 62, which is situated more toward the middle space SP1 than the upper partitioning plate 51, adjoins the upper partitioning plate 51. A plurality of screw holes TH4 are formed in the upper member 62. The upper member 62 is fixed with screws to the ceiling plate 32 and the heat source-side heat exchanger 42 via the screw holes TH4. The upper member 62 includes a left upper part 621, a right upper part 622, a middle upper part 623, a ceiling part 624, and a bottom part 625. The middle upper part 623 and the ceiling part 624 function as bending parts (equivalent to "second bending part" in the claims) for bending the upper air path FP4 described below.

The left upper part 621 is a plate-form portion that constitutes the left end of the upper member 62. The left upper part 621 is fixed with screws to the second tube plate 42*b*. The right upper part 622 is a plate-form portion that constitutes the right end of the upper member 62. The right upper part 622 is fixed with screws to the first tube plate 42*a*. The middle upper part 623 is a portion that constitutes the middle portion of the upper member 62. The middle upper part 623 is situated between the left upper part 621 and the right upper part 622. The middle upper part 623 extends in the left-right direction between the left upper part 621 and the right upper part 622.

The ceiling part 624 extends along the horizontal direction from an upper end of the middle upper part 623. The ceiling part 624 is fixed with screws to the lower surface side of the ceiling plate 32. The bottom part 625 extends along the horizontal direction from a lower end of the middle upper part 623. An upper ventilation opening 62*a* (equivalent to "ventilation opening" in the claims) is formed in the bottom part 625. Specifically, the upper ventilation opening 62*a* is configured with a plurality of slits that are formed in the bottom part 625. The upper ventilation opening 62*a* is formed for communication between the middle space SP1 and the upper air path FP4 in the condition when the upper partitioning plate 51 and the upper member 62 are provided. The upper ventilation opening 62*a* functions as a ventilation opening for allowing the air flow that enters the upper corner space SP3 from the lower corner space SP4 to flow out to the middle space SP1 during operation of the air conditioning apparatus 100.

<Horizontal Partitioning Plate 70>

The heat source unit 20 has a horizontal partitioning plate 70 that extends along the horizontal direction inside the casing 30. The description "extend along the horizontal direction" includes not only the case of extending strictly in the horizontal direction, but also the case of extending slightly tilted toward the horizontal direction. Specifically, the horizontal partitioning plate 70 is to be understood as extending along the horizontal direction if the angle between the horizontal partitioning plate 70 and the horizontal line as seen from the side is between 0° and 30°.

The horizontal partitioning plate 70 is a roughly flat plate-form merriber. As shown in FIG. 3, the horizontal partitioning plate 70 is situated between the upper corner space SP3 and the lower corner space SP4, and partitions the two spaces. As stated above, the horizontal partitioning plate 70 extends along the horizontal direction from the middle lower part 613 of the lower member 61. A lower ventilation opening 71 (equivalent to "first ventilation opening" in the claims) is formed in the horizontal partitioning plate 70. The lower ventilation opening 71 is formed for communication between the upper corner space SP3 and the tower corner space SP4. Specifically, the lower ventilation opening 71 is configured with a plurality of slits that are formed in the horizontal partitioning plate 70. During operation of the air conditioning apparatus 100, the tower ventilation opening 71 functions as a ventilation opening whereby external air for cooling the electronic components contained in the heat source unit controller 47 is taken in from the lower corner space SP4 into the upper corner space SP3.

<Lower Air Flow Path-Forming Member 80>

Figure 17:
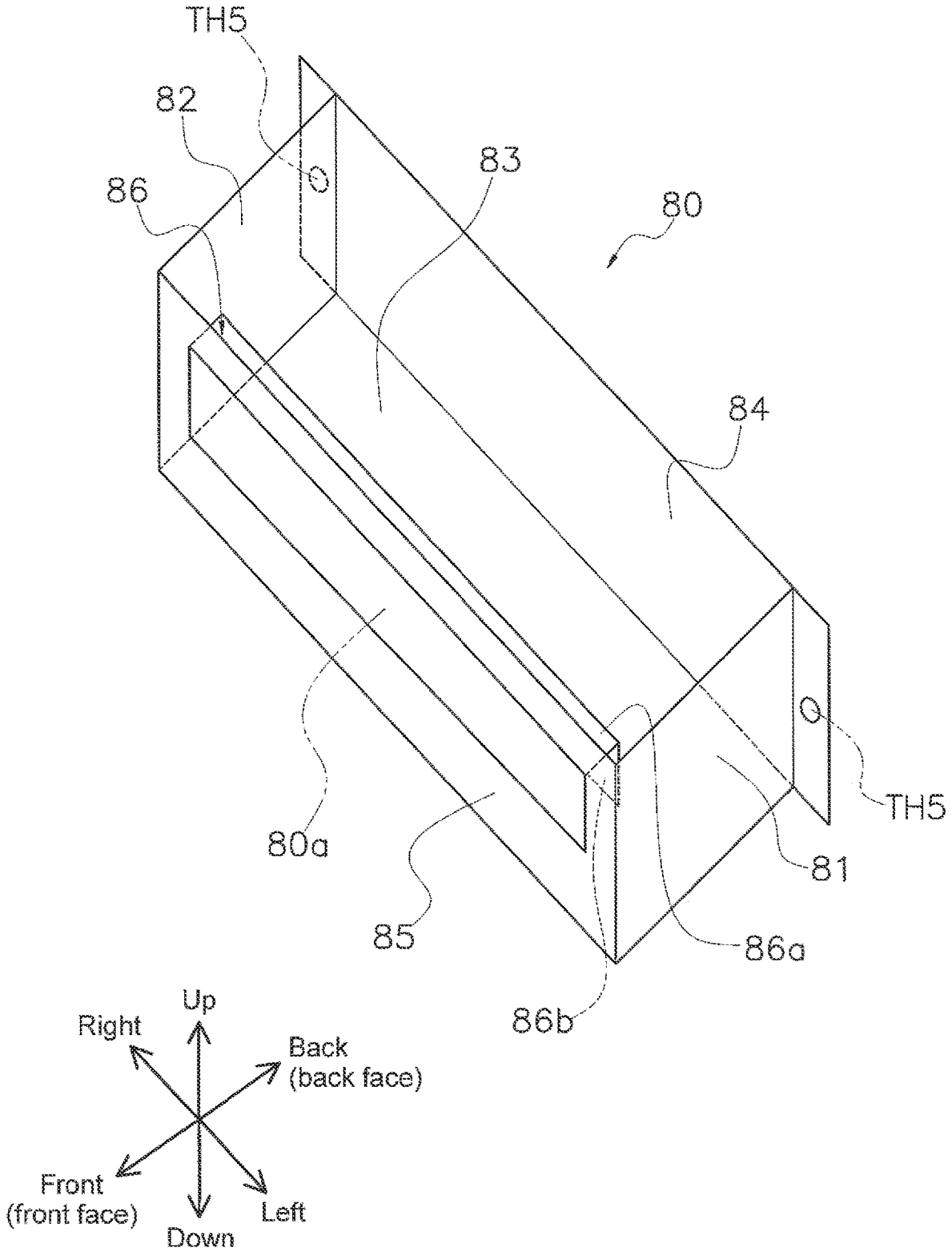
FIG. 17 is a perspective view of a lower air flow path-forming member viewed from the front face side.
Figure 18:
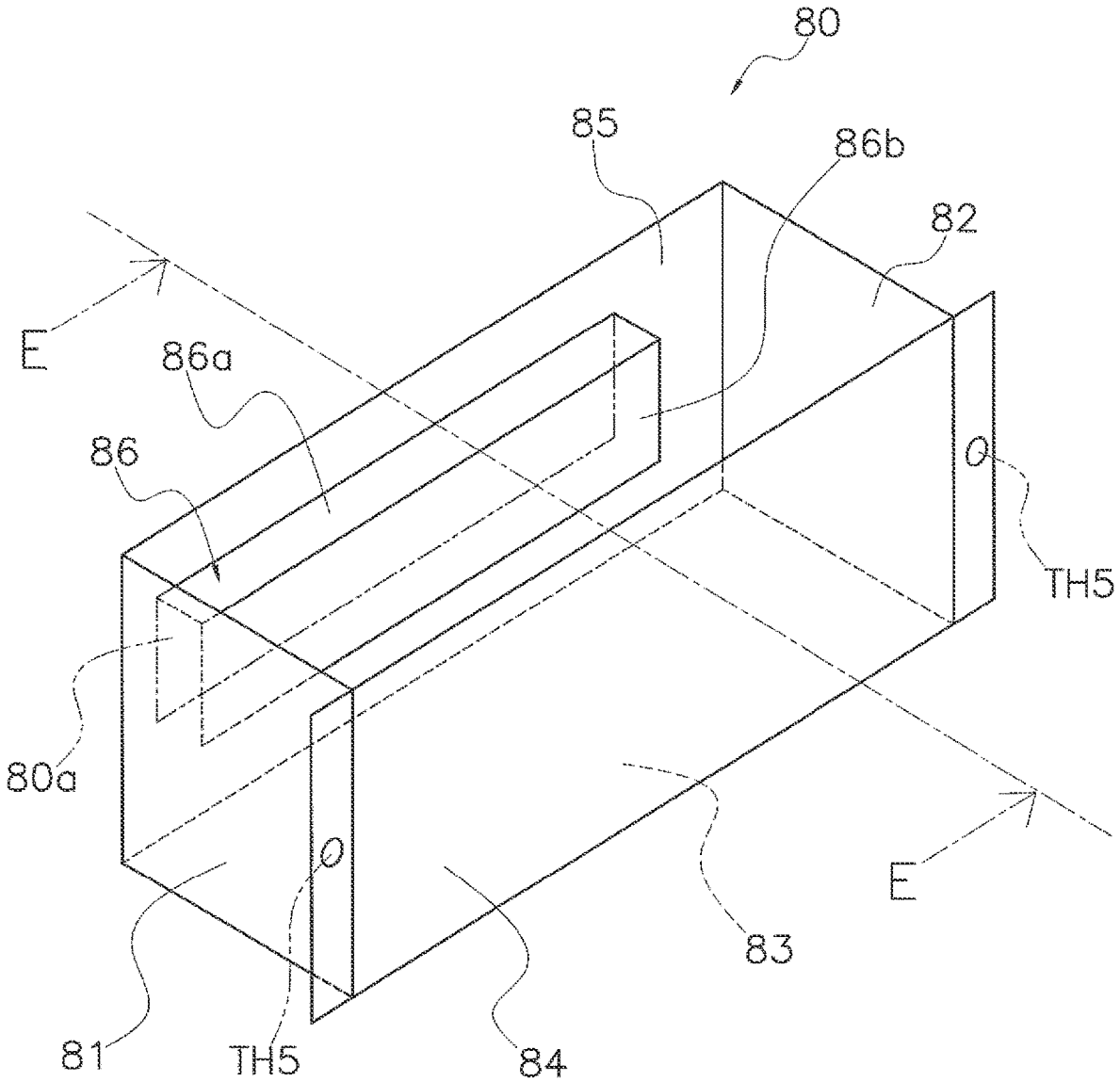
FIG. 18 is a perspective view of the lower air flow path-forming member viewed from the back face side.
Figure 18:
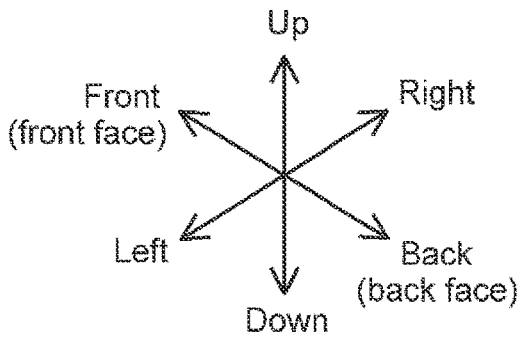
Figure 19:
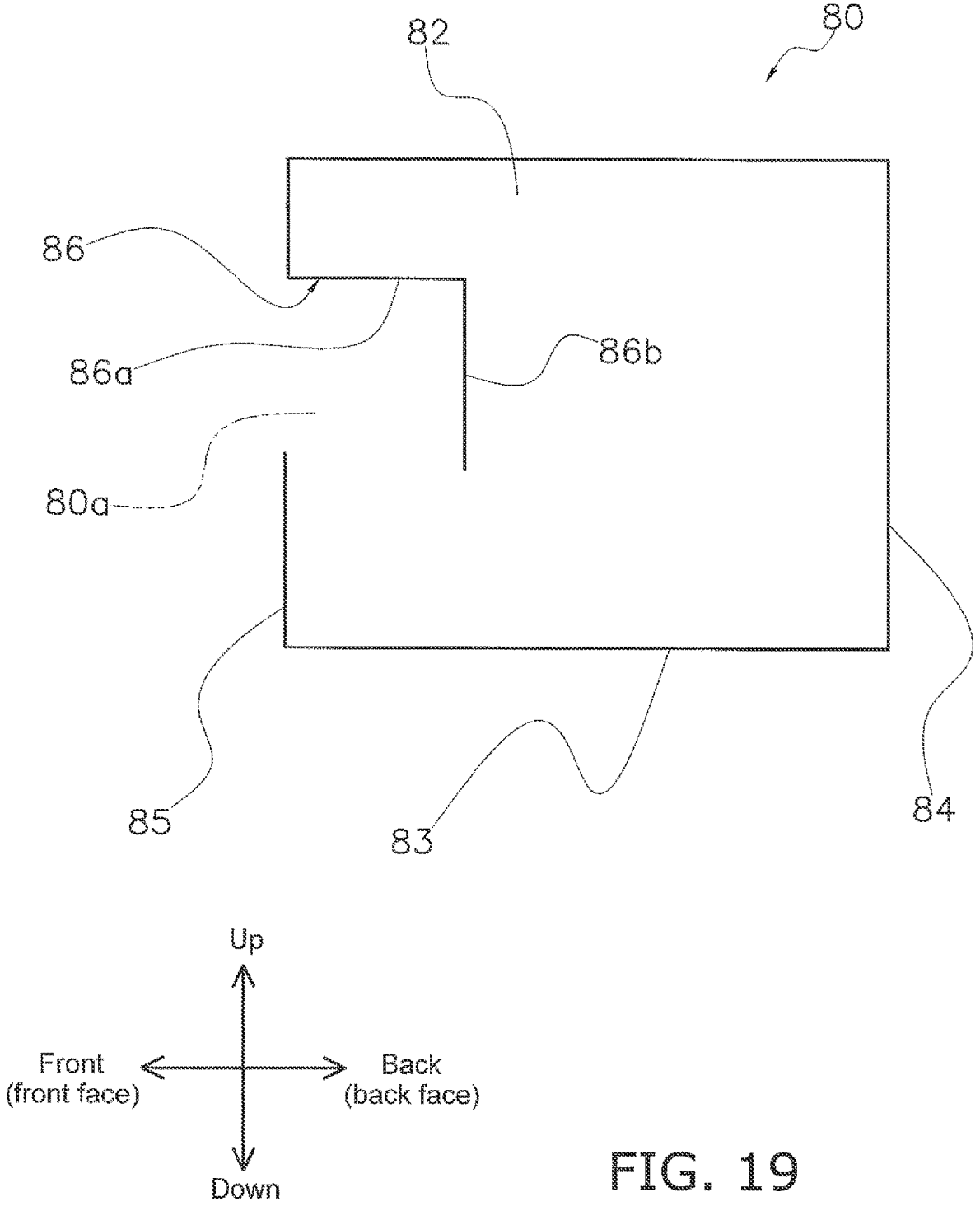
FIG. 19 is a sectional view across line E-E in FIG. 18.
Figure 20:
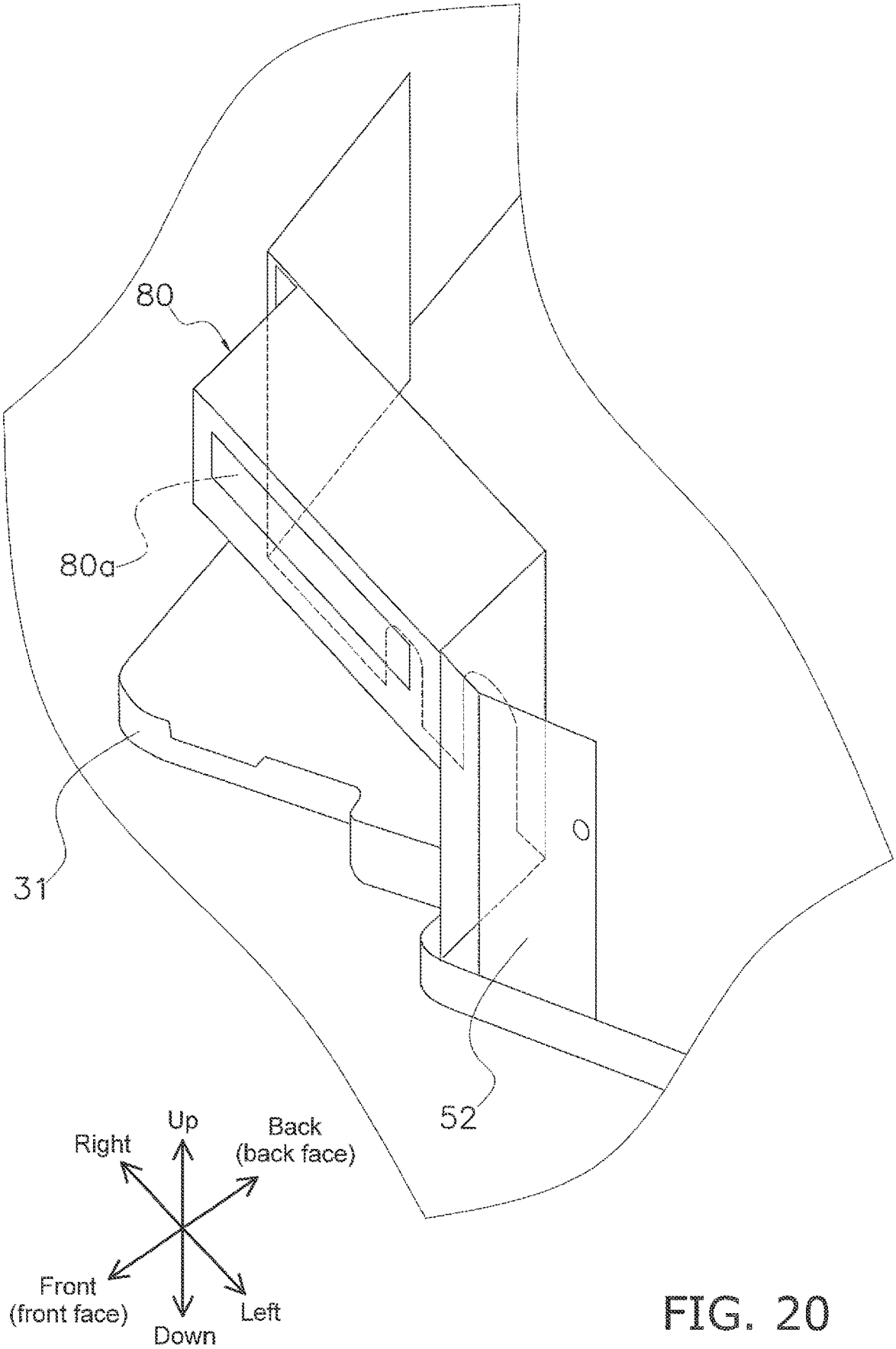
FIG. 20 is a schematic view showing a state in which the lower air flow path-forming member has been disposed on the lower partitioning plate.
Figure 21:
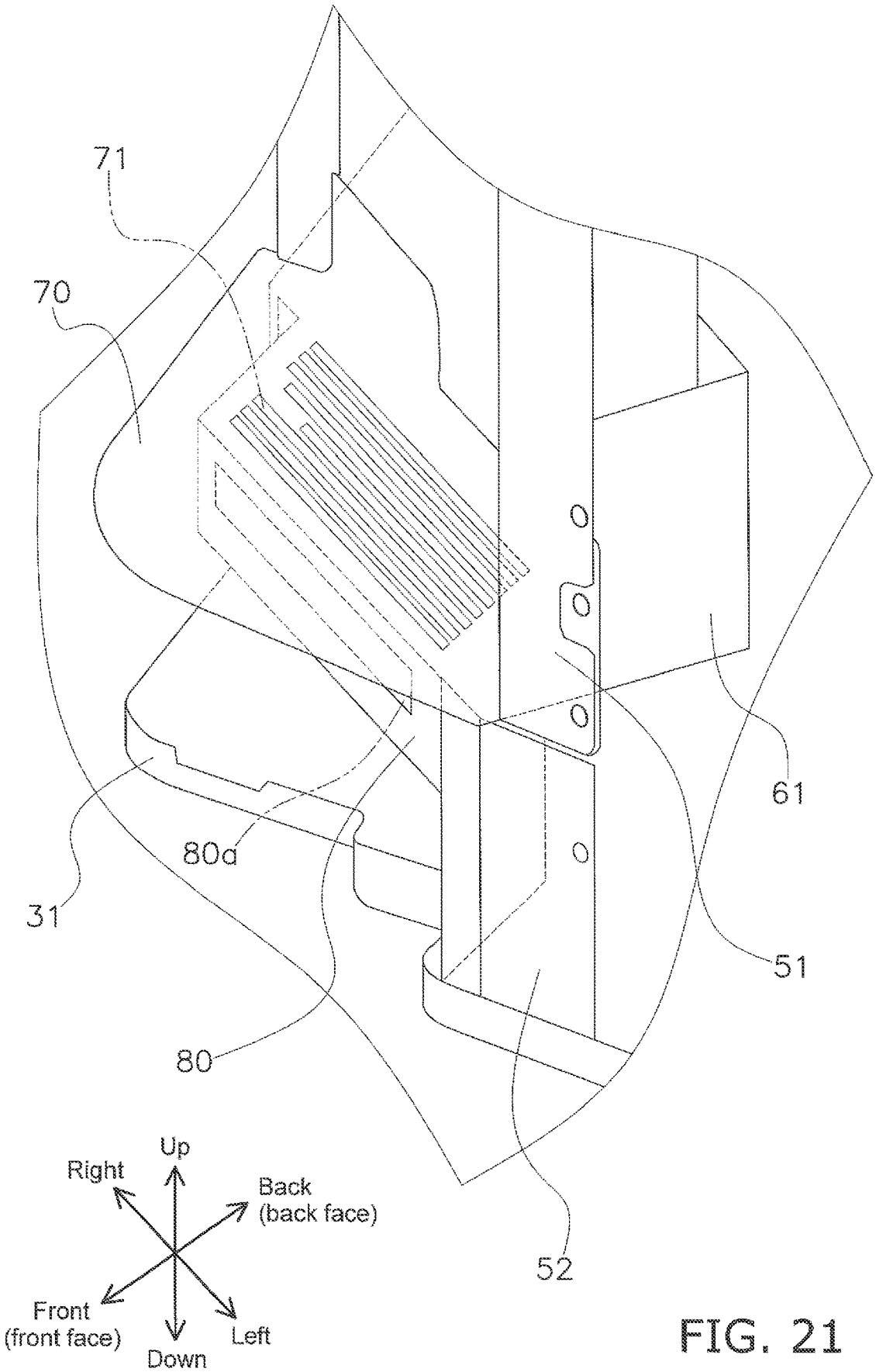
FIG. 21 is a schematic view showing a state in which the lower member and the upper partitioning plate have been disposed in the state shown in FIG. 20.

FIG. 17 is a perspective view of the lower air flow path-forming member 80 viewed from the front. FIG. 18 is a perspective view of the lower air flow path-forming member 80 viewed from the back. FIG. 19 is a sectional view across line E-E in FIG. 18. FIG. 20 is a schematic view showing a state in which the lower air flow path-forming member 80 has been disposed on the lower partitioning plate 52. FIG. 21 is a schematic view showing a state in which the lower member 61 and the upper partitioning plate 51 have been disposed in the state shown in FIG. 20.

The lower air flow path-fbrming member 80 is a member for forming a lower air flow path FP3 that communicates with the lower ventilation opening 71 in the lower corner space SP4. Details concerning the lower air flow path FP3 are described below.

The lower air flow path-forming member 80 has a box-shaped form as shown in FIGS. 17 to 19. The lower air flow path-forming member 80 is situated beneath the horizontal partitioning plate 70 in the lower corner space SP4. More specifically, the lower air flow path-forming member 80 adjoins the horizontal partitioning plate 70 in the lower corner space SP4. A plurality of screw holes TH5 are formed in the lower air flow path-forming member 80. The lower air flow path-forming member 80 is fixed by screws to the lower partitioning plate 52 via the screw holes TH5. The lower air flow path-forming member 80 includes a left side face part 81, a right side face part 82, a bottom face part 83, a back face part 84, a front face part 85, and a flow path bending part 86.

The left side face part 81 constitutes the left side face of the lower air flow path-forming member 80. The right side face part 82 constitutes the right side face of the lower air flow path-forming member 80. The bottom face part 83 constitutes the bottom face of the lower air flow path-forming member 80. The back face part 84 constitutes the back face of the lower air flow path-forming member 80. The front face part 85 constitutes the front face of the lower air flow path-forming member 80. A first opening 80*a* is formed in a middle portion of the front face part 85. The first opening 80*a* is a roughly rectangular, horizontally elongated opening, as seen from the front. The first opening 80*a* functions as a ventilation opening whereby air flow flows into the lower air flow path FP3.

The flow path bending part 86 (equivalent to "first bending part" in the claims) is provided at the edge of the first opening 80*a*. The flow path bending part 86 is provided in order to bend the lower air flow path FP3. The flow path bending part 86 has the shape of the letter "L" when viewed from the side. The flow path bending part 86 includes a first plane part 86*a* and a second plane part 86*b*. The first plane part 86*a* extends along the horizontal direction from the edge of the first opening 80*a*. The second plane part 86*b* extends along the vertical direction (downward) from the back end portion of the first plane part 86*a*. That is, the flow path bending part 86 has a portion that extends along the direction that intersects the horizontal partitioning plate 70 directly below the horizontal partitioning plate 70. In other words, the flow path bending part 86 can be described as extending along a direction (vertical direction) that intersects the direction (horizontal direction) of progression of air flow that has flown into the lower air flow path FP3.

<Air Flow Path Formed in the Casing 30>

Figure 22:
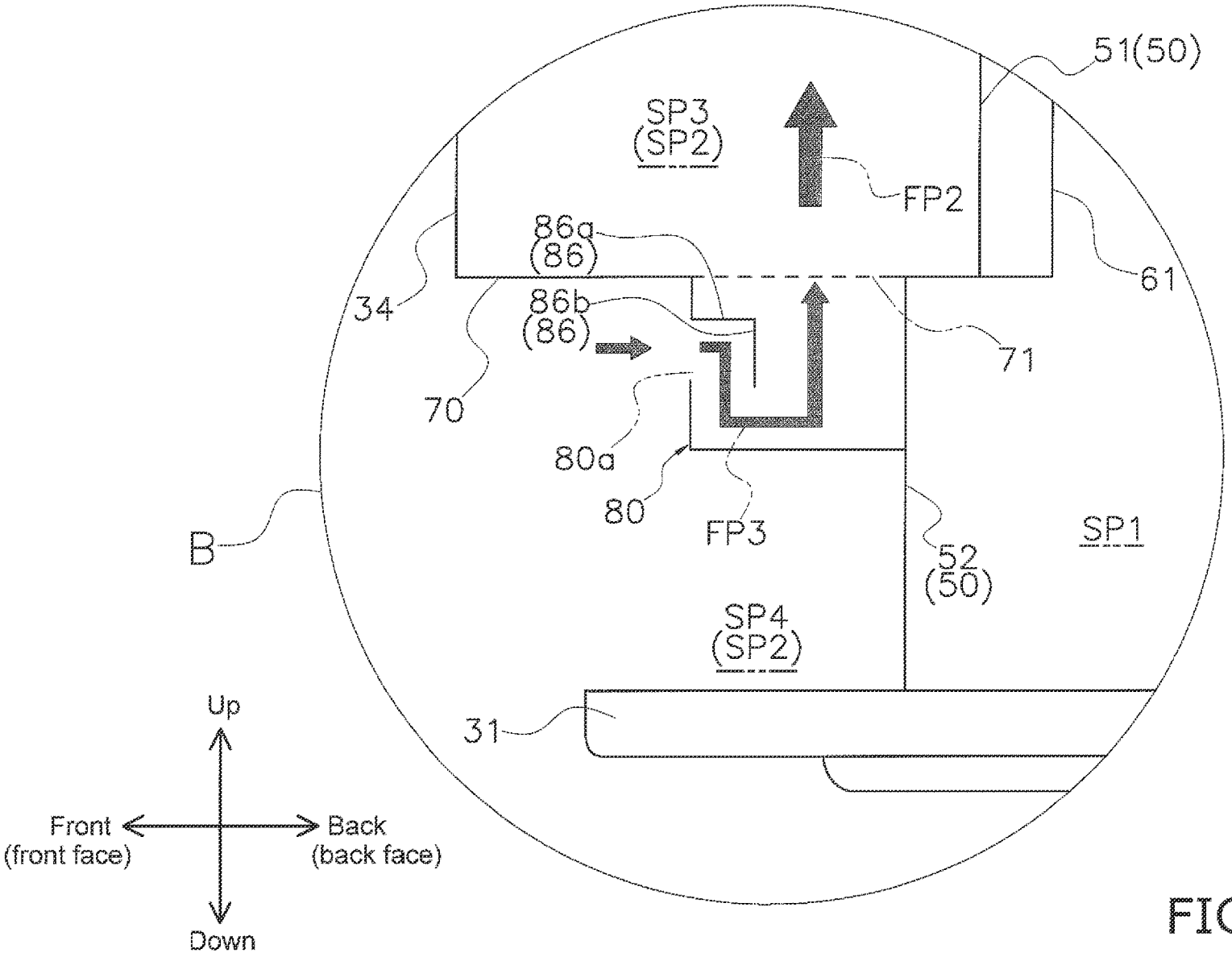
FIG. 22 is an enlarged view of portion B in FIG. 3.
Figure 23:
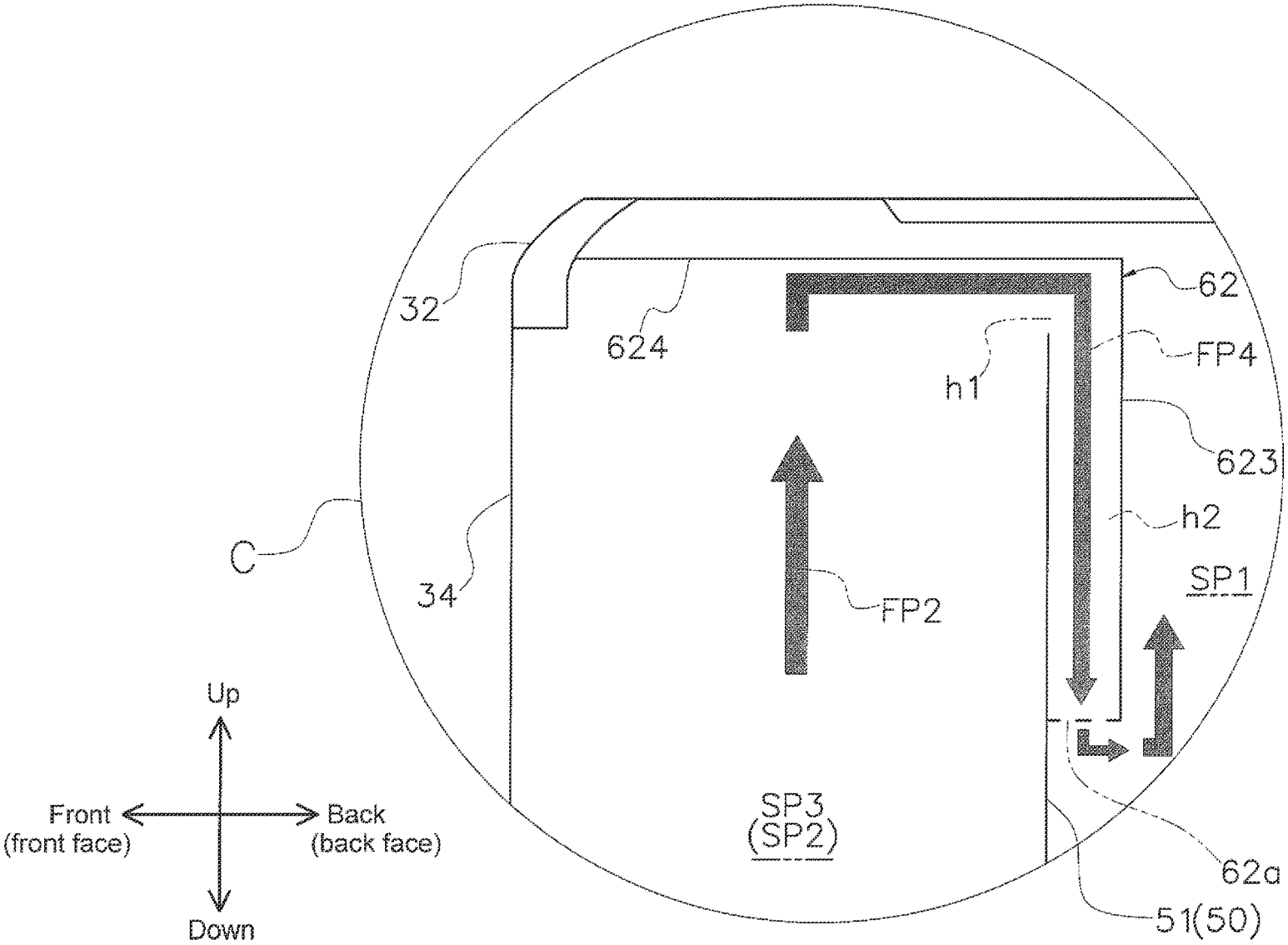
FIG. 23 is an enlarged view of portion C in FIG. 3.

FIG. 22 is an enlarged view of portion B in FIG. 3. FIG. 23 is an enlarged view of portion C in FIG. 3.

When the heat source unit blower 46 operates in the heat source unit 20, an air flow is generated that flows from outside the casing 30 into the interior of the casing 30 and then flows out from the vent 321. A plurality of air flow paths through which the air flow passes are formed inside the casing 30 of the heat source unit 20. Specifically, a middle air flow path FP1, a corner air flow path FP2, the lower air flow path FP3, and an upper air flow path FP4 are formed inside the casing 30.

The middle air flow path FP1 is formed in the middle space SP1. Specifically, the middle air flow path FP1 is formed so that the air flow that has flown into the casing 30 through the side face grill 33 and has passed through the heat source-side heat exchanger 42 is directed toward the vent 321.

The corner air flow path FP2 is formed in the upper corner space SP3. Specifically, the corner air flow path FP2 is formed so that the air flow that has flown into the upper corner space SP3 via the lower ventilation opening 71 is directed toward the upper air flow path FP4. More specifically, the air flow that has flown into the corner air flow path FP2 is turned upwards and passes through the heat source unit controller 47, and then flows into the upper air flow path FP4 after undergoing heat exchange with the electronic components contained in the heat source unit controller 47.

The lower air flow path FP3 is formed in the lower corner space SP4. More specifically, the lower air flow path FP3 is formed in the lower air flow path-forming member 80. Specifically, an intake of the lower air flow path FP3 is the first opening 80*a*. The lower air flow path FP3 is a flow path that leads to the lower ventilation opening 71.

Because the first plane part 86*a* and the second plane part 86*b* are provided in the lower air flow path-forming member 80, the lower air flow path FP3 bends mid-way from the first opening 80*a* to the lower ventilation opening 71. For this reason, as shown in FIG. 22, the air flow that flows into the lower air flow path FP3 via the first opening 80*a* flows along the first plane part 86*a* and the second plane part 86*b*, thereby changing its direction of progress from horizontal to vertical. Then, after the direction of progress has been changed to vertical, the air flow flows in the backwards direction (horizontal direction), in between the lower end of the second plane part 86*b* and the bottom face part 83. After that, the direction of progression is changed to the upwards direction (vertical direction), and the air flow is directed toward the lower ventilation opening 71. In this manner, the first plane part 86*a* and the second plane part 86*b* of the lower air flow path-forming member 80 function as bending parts that bend the lower air flow path FP3.

The upper air flow path FP4 is formed in the upper space of the upper corner space SP3. Also, the upper air flow path FP4 is formed in the space between the upper partitioning plate 51 and the upper member 62. Specifically, the upper air flow path FP4 is a flow path that makes communication between the upper corner space SP3 and the middle space SP1. The corner air flow path FP2 and the upper air flow path FP4 thus communicate, and there is no clear boundary between the two. However, for purposes of explanation, with regard to the air flow path formed in the upper corner space SP3, the portion that is below the height of the upper end of the upper partitioning plate 51 will be described as "corner air flow path FP2," and the portion that is above the height of the upper end of the upper partitioning plate 51 will be described as "upper air flow path FP4."

As shown in FIG. 23, the upper air flow path FP4 is formed along the ceiling part 624 and the middle upper part 623 of the upper member 62. There is a gap h1 between the ceiling part 624 of the upper member 62 and the upper end of the upper partitioning plate 51. In addition, the middle upper part 623 of the upper member 62 and the upper partitioning plate 51 are not in close contact, and there is a gap h2 between the two. By providing the upper member 62 in this aspect, the upper air flow path FP4 is formed in the casing 30, and the gaps h1 and h2 function as a part of the flow path in the upper air flow path FP4. Specifically, the upper member 62 functions to inhibit ingress of liquid and the like from above the upper partitioning plate 51 into the upper corner space SP3. Also, the upper member 62 functions as an upper air flow path-forming member that forms the upper air flow path FP4.

The ceiling part 624 extends along the horizontal direction (that is, a direction intersecting the vertical direction in which the upper partitioning plate 51 extends) directly above the upper partitioning plate 51. In other words, the ceiling part 624 extends along the intersecting direction with respect to the vertical direction in which the corner air flow path FP2 extends. Consequently, the air flow that flows through the corner air flow path FP2 and is directed upwards (vertical direction) flows into the upper air flow path FP4, and has its direction of progress converted to the horizontal direction by flowing along the ceiling part 624. Next, the air flow that flows in the backwards direction (horizontal direction) along the ceiling part 624, while flowing from the gap h1 to the gap h2, has its direction of progress converted downwards (vertical direction) along the middle upper part 623. In this manner, the ceiling part 624 and the middle upper part 623 of the upper member 62 function as bending parts that bend the upper air flow path FP4.

The air flow that flows through the upper air flow path FP4 flows out from the upper ventilation opening 62*a* into the middle space SP1, comes into confluence with the air flow flowing through the middle air flow path FP1, and is vented outwards from the casing 30 via the vent 321. In the manner described above, the upper air flow path FP4 is formed from the upper corner space SP3 to the middle space SP1. In other words, the upper air flow path FP4 is an air flow path that is formed between the upper corner space SP3 and the middle space SP1. Also, the upper air flow path FP4 can be described as interconnecting the upper corner space SP3 and the middle space SP1.

(3) Characteristics of the Heat Source Unit 20

The heat source unit 20 of this embodiment has the following characteristics.

<A>

As described above, the heat source unit 20 of the air conditioning apparatus 100 has the heat source-side heat exchanger 42, the heat source unit blower 46, the heat source unit controller 47 including the electronic components, the casing 30, the vertical partitioning plate 50, and the horizontal partitioning plate 70. The heat source unit controller 47 controls driving of the actuators. The vent 321 for venting air upwards is formed in the casing 30. The casing 30 houses the heat source-side heat exchanger 42, the heat source unit blower 46, and the heat source unit controller 47. The vertical partitioning plate 50 and the horizontal partitioning plate 70 are disposed in the casing 30. The heat source-side heat exchanger 42 has the first side face part 421, the second side face part 422, the third side face part 423, and the fourth side face part 424. The second side face part 422 adjoins the first side face part 421. The third side face part 423 adjoins the second side face part 422 and opposites the first side face part 421. The fourth side face part 424 adjoins the third side face part 423 and opposites the second side face part 422. The vertical partitioning plate 50 is disposed between the first side face part 421 and the fourth side face part 424. The middle space SP1 and the corner space SP2 are formed in the casing 30. The middle space SP1 is surrounded by the first side face part 421, the second side face part 422, the third side face part 423, the fourth side face part 424, and the vertical partitioning plate 50. The corner space SP2 is partitioned from the middle space SP1 by the vertical partitioning plate 50. The corner space SP2 is divided into the upper corner space SP3 and lower corner space SP4 by the horizontal partitioning plate 70. The heat source unit controller 47 is disposed in the upper corner space SP3. The lower corner space SP4 is situated below the upper corner space SP3. The lower corner space SP4 is exposed outwards from the casing 30. The lower ventilation opening 71 is formed in the horizontal partitioning plate 70. The lower ventilation opening 71 is an opening that communicates between the upper corner space SP3 and the lower corner space SP4.

Consequently, a configuration is produced whereby an air flow flows from the outside into the upper corner space SP3 in which the heat source unit controller 47 is disposed. As a result, the heat source unit 20 is configured so that increases in temperature of the electronic components that are contained in the heat source unit controller 47 are inhibited, because the electronic components are cooled by undergoing heat exchange with the air flow flowing into the upper corner space SP3.

<B>

As described above, the lower air flow path-fbrming trtember 80 is disposed in the lower corner space SP4. The lower air flow path-forming member 80 forms the lower air flow path FP3. The lower air flow path FP3 communicates with the lower ventilation opening 71. The lower air flow path-forming member 80 has a flow path bending part 86. The flow path bending part 86 is a portion that makes bending of the lower air flow path FP3.

Consequently, the lower air flow path FP3, which passes to the upper corner space SP3 via the lower ventilation opening 71, bends. As a result, in the heat source unit 20, ingress of liquid, and/or small animals, and the like into the upper corner space SP3 is inhibited.

Moreover, as described above, the lower air flow path-forming member 80 adjoins the horizontal partitioning plate 70 in the lower corner space SP4. The flow path bending part 86 extends along the direction that intersects the horizontal partitioning plate 70.

Consequently, the heat source unit 20 has a simple configuration whereby ingress of liquid, and/or small animals, and the like into the upper corner space SP3 is inhibited.

Moreover, as described above, the horizontal partitioning plate 70 extends along the horizontal direction. The flow path bending part 86 extends along the vertical direction directly below the horizontal partitioning plate 70.

Consequently, the heat source unit 20 has a simple configuration whereby ingress of liquid, and/or small animals, and the like into the upper corner space SP3 is inhibited.

Moreover, as described above, the tower ventilation opening 71 is configured with a plurality of slits that are formed in the horizontal partitioning plate 70.

Consequently, the heat source unit 20 has a simple configuration whereby ingress of liquid, and/or small animals, and the like into the upper corner space SP3 is inhibited.

<C>

As described above, the heat source unit blower 46 is disposed in the middle space SP1. The upper member 62 is disposed between the middle space SP1 and the upper corner space SP3. The upper member 62 forms the upper air flow path FP4. The upper air flow path FP4 is a flow path for air that communicates between the middle space SP1 and the upper corner space SP3.

Consequently, air flow generated by the heat source unit blower 46 flows into the upper corner space SP3. As a result, the heat source unit 20 is configured so that increases in temperature of the electronic components that are contained in the heat source unit controller 47 are inhibited, because the electronic components are cooled by undergoing heat exchange with the air flow flowing into the upper corner space SP3.

In addition, as described above, the upper member 62 has the middle upper part 623 and the ceiling part 624. The ceiling part 624 and the middle upper part 623 function as bending parts that make bending of the upper air flow path FP4.

Consequently, the upper air flow path FP4 that leads to the upper corner space SP3 bends. As a result, in the heat source unit 20, ingress of liquid, and/or small animals, and the like into the upper corner space SP3 is inhibited.

<D>

As described above, the upper member 62 is situated more toward the middle space SP1 than the upper partitioning plate 51, and adjoins the upper partitioning plate 51. The upper air flow path FP4 is formed between the upper partitioning plate 51 and the upper member 62. The ceiling part 624 extends in the direction that intersects the upper partitioning plate 51, and functions as the bending part that makes bending of the upper air flow path FP4.

Consequently, the heat source unit 20 has a simple configuration whereby ingress of liquid, and/or small animals, and the like into the upper corner space SP3 is inhibited.

In addition, as described above, the upper partitioning plate 51 extends along the vertical direction. The ceiling part 624 extends along the horizontal direction directly above the upper partitioning plate 51, and functions as a bending part that makes bending of the upper air flow path FP4.

Consequently, the heat source unit 20 has a simple configuration whereby ingress of liquid, and/or small animals, and the like into the upper corner space SP3 is inhibited.

Moreover, as described above, the upper ventilation opening 62*a* that communicates between the upper air flow path FP4 and the middle space SP1 is formed in the upper member 62. The upper ventilation opening 62*a* is configured with a plurality of slits that are formed in the bottom part 625.

Consequently, the heat source unit 20 has a simple configuration whereby ingress of liquid, and/or small animals, and the like into the upper corner space SP3 is inhibited.

(4) Modification Example

<A>

In the embodiments described above, the upper member 62 functions as a member for inhibiting ingress of liquid and the like from above the upper partitioning plate 51 into the upper corner space SP3 and also functions as an upper air flow path-forming member for forming the upper air flow path FP4. However, the upper member 62 may function only as the upper air flow path-forming member, eliminating the function of the upper member 62 in regard to inhibiting ingress of liquid or the like into the upper corner space SP3.

<B>

In the above embodiments, the horizontal partitioning plate 70 was configured integrally with the lower member 61. However, the horizontal partitioning plate 70 may be configured as a separate body from the lower member 61. In such a case, the horizontal partitioning plate 70 may be fixed to the lower member 61 and/or the lower partitioning plate 52.

<C>

In the above embodiments, the first opening 80*a* was formed in the front face part 85 in the lower air flow path-forming member 80. However, the first opening 80*a* need not necessarily be formed in the front face part 85. For example, the first opening 80*a* may be formed in the bottom face part 83. In such a case, the flow path bending part 86 may be formed so as to extend from the edge of the first opening 80*a* formed in the bottom face part 83.

<D>

In the above embodiment, the flow path bending part 86 had the first plane part 86*a* and the second plane part 86*b* and was configured so as to have the shape of the letter L when viewed from the side face. However, the flow path bending part 86 is not restricted to this shape. Specifically, the flow path bending part 86 may be configured to have any shape that makes bending of the lower air flow path FP3. In other words, the flow path bending part 86 may be configured to have any shape, provided that it has a portion that extends in the direction that intersects the direction of progress of the air flow that flows into the lower air flow path FP3.

What is claimed is:

1. A heat source unit of a refrigerating apparatus, comprising:

a heat exchanger;

a blower;

an electronic component configured to control driving of an actuator;

a casing housing the heat exchanger, the blower, and the electronic component, the casing having a vent configured and arranged to vent air upward; and first and second partitioning plates disposed in the casing, the heat exchanger having a first side face part, a second side face part adjoining the first side face part, a third side face part opposing the first side face part and adjoining the second side face part, and a fourth side face part opposing the second side face part and adjoining the third side face part, the first partitioning plate being disposed between the first side face part and the fourth side face part, the first partitioning plate being configured and arranged to extend along a vertical direction that is a direction at which an angle between a vertical line is 0° to within 30° and that intersects a horizontal direction that is a direction at which an angle between a horizontal line is 0° to within 30°, an interior of the casing having a first space surrounded by the first side face part, the second side face part, the third side face part, the fourth side face part and the first partitioning plate, and a second space partitioned from the first space by the first partitioning plate, the second space being divided by the second partitioning plate into a third space, and a fourth space situated below the third space and is exposed externally from the casing, the electronic component being disposed in the third space, a side of the fourth space being open to outside of the casing, the second partitioning plate having a first ventilation opening communicating between the third space and the fourth space formed therein, the blower being disposed in the first space, and an air flow path configured to communicate between the first space and the third space being formed in the casing.

2. The heat source unit of the refrigerating apparatus according to claim 1, further comprising a first member disposed in the fourth space, the first member being configured and arranged to form a first air flow path that communicates with the first ventilation opening, and the first member having a first bending part that is configured and arranged to bend the first air flow path.

3. The heat source unit of the refrigerating apparatus according to claim 2, wherein the first member adjoins the second partitioning plate in a fourth space side, and the first bending part extends in a direction intersecting with the second partitioning plate.

4. The heat source unit of the refrigerating apparatus according to claim 3, wherein the second partitioning plate extends along a horizontal direction, and the first bending part extends along a vertical direction directly below the second partitioning plate.

5. The heat source unit of the refrigerating apparatus according to claim 1, wherein the first ventilation opening includes a plurality of slits that are formed in the second partitioning plate.

6. The heat source unit of the refrigerating apparatus according to claim 1, further comprising a second member disposed between the first space and the third space, the second member being configured and arranged to form a second air flow path that communicates between the first space and the third space.

7. The heat source unit of the refrigerating apparatus according to claim 6, wherein the second member has a second bending part configured and arranged to bend the second air flow path.

8. The heat source unit of the refrigerating apparatus according to claim 7, wherein the second member adjoins the first partitioning plate on a first space side, the second air flow path is formed between the first partitioning plate and the second member, and the second bending part extends in a direction intersecting the first partitioning plate.

9. The heat source unit of the refrigerating apparatus according to claim 8, wherein the second bending member extends along a horizontal direction directly above the first partitioning plate.

10. The heat source unit of the refrigerating apparatus according to claim 6, wherein the second member having a second ventilation opening communicating between the second air flow path and the first space formed therein, and the second ventilation opening includes a plurality of slits.

11. A heat source unit of a refrigerating apparatus, comprising:

a heat exchanger;

a blower;

an electronic component configured to control driving of an actuator;

a casing housing the heat exchanger, the blower, and the electronic component, the casing having a vent configured and arranged to vent air upward;

a first member; and first and second partitioning plates disposed in the casing, the heat exchanger having a first side face part, a second side face part adjoining the first side face part, a third side face part opposing the first side face part and adjoining the second side face part, and a fourth side face part opposing the second side face part and adjoining the third side face part, the first partitioning plate being disposed between the first side face part and the fourth side face part, an interior of the casing having a first space surrounded by the first side face part, the second side face part, the third side face part, the fourth side face part and the first partitioning plate, and a second space partitioned from the first space by the first partitioning plate, the second space being divided by the second partitioning plate into a third space, and a fourth space situated below the third space and is exposed externally from the casing, the electronic component being disposed in the third space, a side of the fourth space being open to outside of the casing, the second partitioning plate having a first ventilation opening communicating between the third space and the fourth space formed therein, and the first member being disposed in the fourth space, and the first member and the first partition plate cooperating to surround an area below the second partition plate and the first ventilation opening, with the first member being shaped so that air enters the area horizontally before flowing vertically from the area through the first ventilation opening.

12. A heat source unit of a refrigerating apparatus, comprising:

a heat exchanger;

a blower;

an electronic component configured to control driving of an actuator;

a casing housing the heat exchanger, the blower, and the electronic component, the casing having a vent configured and arranged to vent air upward; and first and second partitioning plates disposed in the casing, the heat exchanger having a first side face part, a second side face part adjoining the first side face part, a third side face part opposing the first side face part and adjoining the second side face part, and a fourth side face part opposing the second side face part and adjoining the third side face part, the first partitioning plate being disposed between the first side face part and the fourth side face part, the first partition plate having the electronic component mounted thereon, an interior of the casing having a first space surrounded by the first side face part, the second side face part, the third side face part, the fourth side face part and the first partitioning plate, and a second space partitioned from the first space by the first partitioning plate, the second space being divided by the second partitioning plate into a third space, and a fourth space situated below the third space and is exposed externally from the casing, the electronic component being disposed in the third space, a side of the fourth space being open to outside of the casing, the second partitioning plate having a first ventilation opening communicating between the third space and the fourth space formed therein, and the first ventilation opening overlapping the electronic component mounted on the first partition plate as seen vertically in a plan view.

* * * * *